US006102595A

United States Patent [19]

Satoh et al.

[11] Patent Number: 6,102,595

[45] **Date of Patent: *Aug. 15, 2000**

[54] SHEET SUPPLY APPARATUS HAVING INCLINED FEEDING CORRECTING FUNCTION AND RECORDING APPARATUS

[75] Inventors: Fumihiro Satoh; Haruhiko Yashima; Hideaki Kumasaka, all of Inagi, Japan

[73] Assignees: Fujitsu Limited, Kawasaki; Fujitsu Isotec Limited, Inagi, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/351,459

[22] Filed: Jul. 12, 1999

[30] Foreign Application Priority Data

Dec. 28, 1998 [JP] Japan ..... 10-374642

[51] Int. Cl.[7] ..... B41J 11/42

[52] U.S. Cl. ..... 400/579; 400/631; 400/641; 271/250

[58] Field of Search ..... 400/579, 630, 400/641, 624, 631, 632, 632.1, 633, 636; 271/226, 229, 233, 234, 241, 242, 248, 250

[56] References Cited

U.S. PATENT DOCUMENTS

| | | | |
|---|---|---|---|
| 5,088,848 | 2/1992 | De Falco et al. | 400/630 |
| 5,188,471 | 2/1993 | Mattila | 400/630 |
| 5,462,373 | 10/1995 | Chia | 400/62.4 |
| 5,466,079 | 11/1995 | Quintana | 400/579 |
| 5,648,808 | 7/1997 | Yanagi et al. | 271/229 |
| 5,697,298 | 12/1997 | Greive et al. | 400/579 |
| 5,725,319 | 3/1998 | Saito et al. | 400/629 |
| 5,813,782 | 9/1998 | Mason | 400/636 |
| 5,816,722 | 10/1998 | Fujiwara et al. | 400/605 |
| 5,859,653 | 1/1999 | Aoki et al. | 347/8 |
| 5,887,996 | 3/1999 | Castelli et al. | 400/579 |
| 5,894,318 | 4/1999 | Endo | 347/262 |
| 5,957,050 | 9/1999 | Scheffer et al. | 101/227 |

FOREIGN PATENT DOCUMENTS

| | | | |
|---|---|---|---|
| EP 0 884 258 A2 | 12/1998 | European Pat. Off. . | |
| 58-112774 | 7/1983 | Japan | 400/579 |
| 55-31796 | 3/1984 | Japan . | |
| 60-118542 | 6/1985 | Japan . | |
| 63-37657 | 3/1988 | Japan . | |
| 4-089744 | 3/1992 | Japan . | |
| 6-71961 | 3/1994 | Japan . | |
| 6-289673 | 10/1994 | Japan . | |
| 8-002747 | 1/1996 | Japan . | |
| 9-118016 | 7/1997 | Japan . | |
| 9-188016 | 7/1997 | Japan . | |

*Primary Examiner*—Christopher A. Bennett
*Attorney, Agent, or Firm*—Armstrong, Westerman, Hattori, McLeland & Naughton

[57] ABSTRACT

A sheet supply apparatus can be releasably attached to a printer. The sheet supply apparatus includes a frame having a sheet conveyance surface, and a shaft arranged above the sheet conveyance surface and having protrusions for correcting inclined feeding of a sheet while conveying the sheet. A plurality of supply sensors are disposed above the sheet conveyance surface at positions beyond the shaft, and in a line parallel to the shaft, for detecting presence or absence of a sheet. The sensors can also detect the size of the sheet to control the carrier of the printer to realize a random set of the sheet.

12 Claims, 22 Drawing Sheets

Fig.16

| DETECTION CONDITION | STEP NUMBER |
|---|---|
| DETECTED BY ONE SENSOR | N1 |
| DETECTED BY TWO SENSORS | N2-X1 |
| DETECTED BY THREE SENSORS | N3-X2 |
| DETECTED BY FOUR SENSORS | N4-X3 |
| RETRY INTAKE | N1+X4 |

Fig.17

| NO. | PSS1 | PSS2 | PSS3 | PSS4 | CARRIER TRAVELLING POSITION |
|---|---|---|---|---|---|
| 1 | × | × | × | × | POSITION OF CUT SHEET |
| 2 | ○ | × | × | × | POSITION AT WHICH LEFT SENSOR(84a) COMES ON EXTENSION OF PSS1 |
| 3 | × | ○ | × | × | POSITION AT WHICH LEFT SENSOR(84a) COMES ON EXTENSION OF PSS2 |
| 4 | ○ | ○ | × | × | CENTRAL POSITION BETWEEN PSS1 AND PSS2 |
| 5 | × | × | ○ | × | POSITION AT WHICH LEFT SENSOR(84a) COMES ON EXTENSION OF PSS3 |
| 6 | ○ | × | ○ | × | POSITION OF CUT SHEET |
| 7 | × | ○ | ○ | × | CENTRAL POSITION BETWEEN PSS2 AND PSS3 |
| 8 | ○ | ○ | ○ | × | CENTRAL POSITION BETWEEN PSS1 AND PSS3 |
| 9 | × | × | × | ○ | POSITION AT WHICH LEFT SENSOR(84a) COMES ON EXTENSION OF PSS4 |
| 10 | ○ | × | × | ○ | POSITION OF CUT SHEET |
| 11 | × | ○ | × | ○ | POSITION OF CUT SHEET |
| 12 | ○ | ○ | × | ○ | POSITION OF CUT SHEET |
| 13 | × | × | ○ | ○ | CENTRAL POSITION BETWEEN PSS3 AND PSS4 |
| 14 | ○ | × | ○ | ○ | POSITION OF CUT SHEET |
| 15 | × | ○ | ○ | ○ | CENTRAL POSITION BETWEEN PSS2 AND PSS4 |
| 16 | ○ | ○ | ○ | ○ | CENTRAL POSITION BETWEEN PSS1 AND PSS4 |

SHEET SUPPLY APPARATUS HAVING INCLINED FEEDING CORRECTING FUNCTION AND RECORDING APPARATUS

BACKGROUND OF THE INVENTION

1. Field of the Invention

The present invention relates to a sheet supply apparatus for supplying a sheet while automatically correcting inclined feeding of the sheet and a recording apparatus, and more in particular, to a sheet supply apparatus permitting a sheet to be set anywhere in the full range (random set) and a recording apparatus.

2. Description of the Related Art

The printer includes a printing head supported by a carrier and a platen opposed to the printing head, wherein a sheet is conveyed between the printing head and the platen by a pair of sheet conveyance rollers, and the sheet is printed by the printing head. The sheet can be supplied toward the sheet conveyance rollers automatically or manually.

A problem of inclined feeding of the sheet arises when a sheet is supplied toward the sheet conveyance rollers. Inclined feeding is liable to occur when the sheet is supplied by hand. Inclined feeding is a phenomenon in which a sheet is supplied with its upper end (the leading side of the sheet in the direction of conveyance) in an inclined position with respect to the sheet conveyance rollers. If the sheet is supplied to the sheet rollers in the inclined position, the sheet conveyance rollers convey the sheet to the printing head in the inclined position, so that the sheet cannot be neatly printed. Therefore, if a sheet is inclined when supplying a sheet, it is desirable to correct inclined feeding.

Japanese patent application No. 10-071644 which is earlier than to the present application discloses a sheet supply apparatus capable of correcting inclined feeding of the sheet. This sheet supply apparatus comprises a frame having a sheet conveyance surface, a shaft arranged rotatably above the sheet conveyance surface, a plurality of protrusions formed on the shaft in an axially spaced relationship and at circumferentially different angles, and a rotating unit for rotating the shaft, whereby the sheet is conveyed toward the sheet conveyance rollers in the printer along the sheet conveyance surface by the protrusions, so as to cause the sheet to abut against the sheet conveyance rollers to thereby correct inclined feeding.

In this sheet supply apparatus, in the case where the sheet is supplied inclined, one side end of the upper end (left end of the leading side of the sheet in the conveyance direction, for example) of the sheet comes into contact with the stationary sheet conveyance rollers. When one end of the sheet comes into contact with the sheet conveyance rollers, that one end of the sheet stops, and the other portion of the sheet continues to be conveyed by the protrusions of the shaft, so that the sheet rotates about the stopped end to thereby correct inclined feeding. In this case, it is the protrusions that convey and engage the sheet for rotating it. The protrusions do not restrict the sheet unlike a pair of pinch rollers, and therefore the sheet is easily and positively rotated thereby to correct the sheet diagonal travel.

A supply sensor is arranged to detect that a sheet is placed on the sheet conveyance surface of the sheet supply apparatus, so that the shaft begins to rotate and conveys the sheet while at the same time correcting inclined feeding thereof in response to the output of this supply sensor. This supply sensor is arranged at a position slightly to the left of the sheet supply apparatus. In the printer or the like, the sheet is usually set at a slightly left position, and the supply sensor arranged at a slightly left position can sufficiently detect the presence or the absence of the sheet placed on the sheet conveyance surface. However, there is a problem in which the supply sensor arranged at a slightly left position cannot detect a sheet if a sheet is set at a slightly right position or a small sheet is set at the center.

SUMMARY OF THE INVENTION

The object of the present invention is to provide a sheet supply apparatus and a recording apparatus which can detect a sheet wherever it is set and which can correct inclined feeding of the sheet.

A sheet supply apparatus according to the present invention comprises a sheet conveyance surface for inserting a sheet thereon, an inclined feeding correcting device for conveying a sheet on the sheet conveyance surface and correcting inclined feeding of the sheet, and a plurality of sensors for detecting the presence or the absence of a sheet on the sheet conveyance surface beyond the inclined feeding correcting device in the sheet conveyance direction and in the direction perpendicular to the sheet conveyance direction. The inclined feeding correcting device includes a shaft arranged rotatably above the sheet conveyance surface, a plurality of protrusions formed on the shaft in axially spaced relationship and at circumferentially different phases, and a rotating unit for rotating the shaft, whereby a sheet is conveyed by the protrusions along the sheet conveyance surface toward a transverse member extending in the direction perpendicular to the sheet conveyance direction, so as to cause the sheet to abut against the transverse member to thereby correct inclined feeding of the sheet, and the sensors are arranged on a line parallel to the shaft in a spaced relationship.

With this configuration, a sheet can be detected wherever it is set, which makes it possible for a sheet to be set over the full range (random set). Further, any type of sheet including a comparatively large sheet and a comparatively small sheet can be conveyed while inclined feeding thereof is corrected automatically, simply by placing the sheet on the sheet conveyance surface. Provision of a plurality of supply sensors makes it possible to add such control functions as moving the carrier or detecting the lower end of the sheet when the sheet is introduced into a recording apparatus such as a printer. In this way, the sheet feeding can be positively corrected, while introducing and delivering the sheet, with a simple structure and simple control operation.

A recording apparatus according to the present invention comprises a casing, a movable carrier, a printing head mounted to the carrier, a platen opposed to the printing head, a pair of sheet conveyance rollers arranged on one side of the platen, and a sheet supply apparatus capable of supplying a sheet toward the sheet conveyance rollers. The sheet supply apparatus includes, similar to that described above, a frame having a sheet conveyance surface, an inclined feeding correcting device for conveying a sheet placed on the sheet conveyance surface and correcting inclined feeding of the sheet, and a plurality of sensors for detecting presence or absence of a sheet placed on the sheet conveyance surface at a position beyond the inclined feeding correcting device.

This inclined feeding correcting device includes a shaft arranged rotatably above the sheet conveyance surface, a plurality of protrusions formed on the shaft in an axially spaced relationship and circumferentially different phases, and a rotating unit for rotating the shaft, whereby a sheet is conveyed by the protrusions toward the sheet conveyance rollers, so as to cause the sheet to abut against the sheet conveyance rollers to thereby correct inclined feeding of the sheet, and the sensors are arranged, in a line, parallel to the shaft in a spaced relationship.

Preferably, the sheet supply apparatus and the recording apparatus comprise sheet conveyance amount determining means for determining the sheet conveyance amount of the shaft in response to the number of the supply sensors that have detected the presence of a sheet.

The sheet conveyance surface of the sheet supply apparatus has depressions corresponding to the positions of the protrusions.

The recording apparatus comprises means for moving the carrier in response to the output signals of the supply sensors and the type of the sheet.

The recording apparatus comprises means for detecting the lower end of a sheet in response to the output of the supply sensors.

The recording apparatus comprises a pair of sheet upper end sensors arranged on the carriers and means for detecting the upper end of a sheet in response to the output of the sheet upper end sensors.

The apparatus comprises means for detecting inclined feeding of a sheet in response to the output of the sheet upper end sensors.

The recording apparatus comprises retry means for driving the sheet conveyance rollers, and the shaft, in reverse to discharge the sheet to the sheet supply apparatus when inclined feeding of the sheet is detected, and then supplying the sheet toward the sheet conveyance rollers by reactivating the sheet supply apparatus.

The recording apparatus comprises means for detecting the width of a sheet in response to the output of the sheet upper end sensor.

The recording apparatus comprises retry means for driving the sheet conveyance rollers, and the shaft, in reverse to discharge the sheet to the sheet supply apparatus and then supplying the sheet toward the sheet conveyance rollers by reactivating the sheet supply apparatus when the width of the sheet is detected to be smaller than a predetermined value.

BRIEF DESCRIPTION OF THE DRAWINGS

The present invention will become more apparent, from the following description of the preferred embodiments, after reference to the accompanying drawings in which:

FIG. 16 is a diagram showing the relationship between the output of the supply sensors arranged in the sheet supply apparatus and the number of driving steps of the shaft;

FIG. 17 is a diagram showing the relationship between the output of the supply sensors arranged in the sheet supply apparatus and the carrier travel position;

DESCRIPTION OF THE PREFERRED EMBODIMENTS

Embodiments of the present invention will be explained below with reference to the drawings. In the description that follows, the wording "a sheet" is considered to include a thin or thick sheet of paper, a bumdle of a plurality of sheets such as copying sheets, or a passbook.

Figure 1:
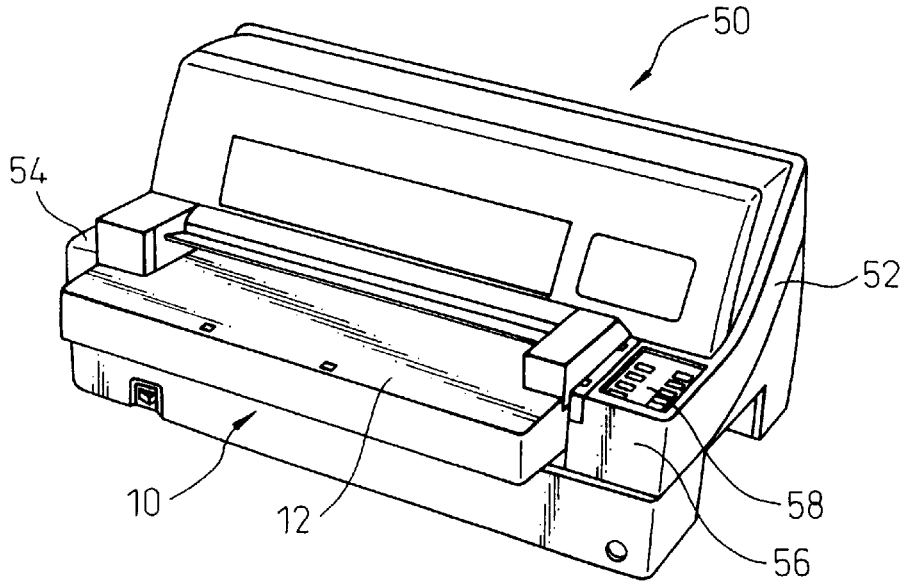
FIG. 1 is a perspective view of a printer having a sheet supply apparatus according to the embodiment of the present invention.
Figure 2:
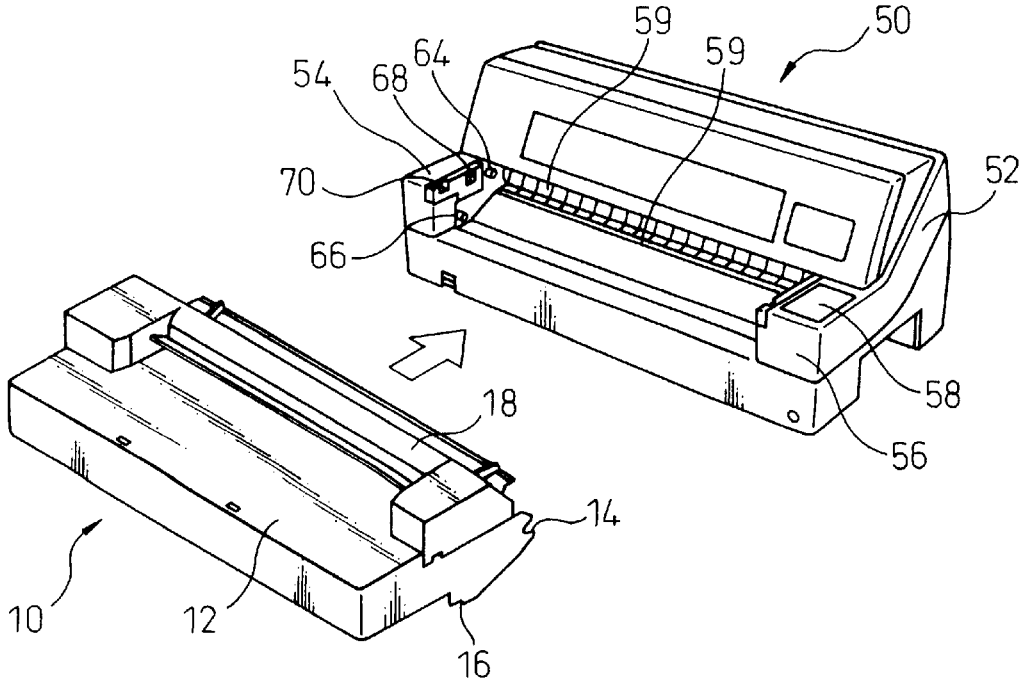
FIG. 2 is a perspective view of the printer and the sheet supply apparatus when the sheet supply apparatus is being mounted to the printer.

FIG. 1 shows a printer (recording apparatus) 50 having a sheet supply apparatus 10. FIG. 2 shows the printer 50 and the sheet supply apparatus 10 when the sheet supply apparatus 10 is mounted to the printer 50. The printer 50 has a casing 52, which has front side walls 54 and 56. The sheet supply apparatus 10 is adapted to be mounted between the front side walls 54 and 56 of the casing 52. An operating panel 58 is arranged on the front side wall 56 of the casing 52. Further, the casing 52 has a sheet guide 59, and a pair of sheet conveyance rollers 60 and 62 (FIG. 6) are disposed in the casing 52. One of sheet conveyance rollers 60 and 62 is a driving roller, and the other is a driven roller rotated by the driving roller in contact therewith.

In FIG. 2, the inner surfaces of the front side walls 54 and 56 of the casing 52 have studs 64 and 66, respectively, as means for mounting the sheet supply apparatus 10. Also, the inner surfaces of the front side walls 54 and 56 of the casing 52 have recesses (grooves) 68 and 70, respectively, for mounting a table 88 on which the sheet is to be placed when the sheet supply apparatus 10 is not used. The sheet supply apparatus 10, on the other hand, has a frame 12 which has mounting recesses 14 and 16 on the forward end and the bottom, respectively, of the side walls.

Figure 3A:
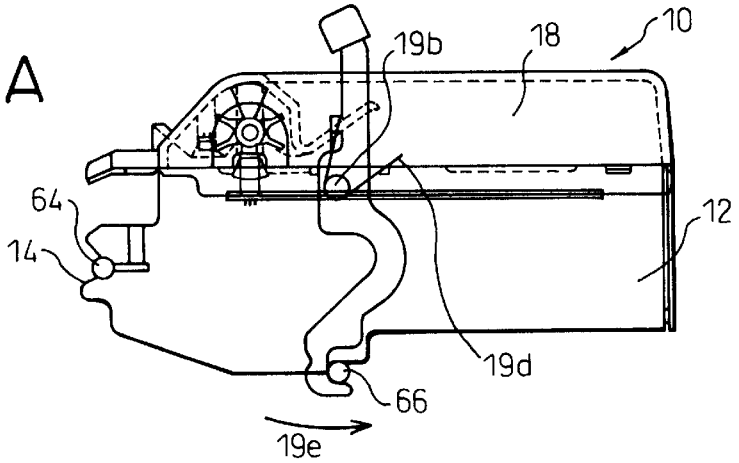
FIGS. 3A to 3C are side views of the sheet supply apparatus when removed from the printer.
Figure 3B:
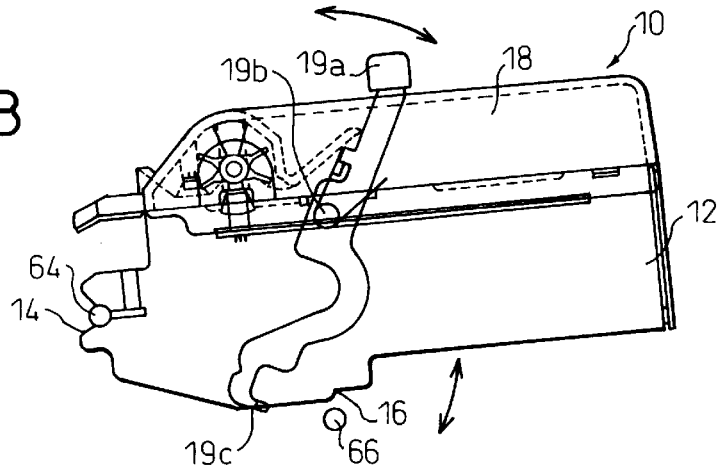
Figure 3C:
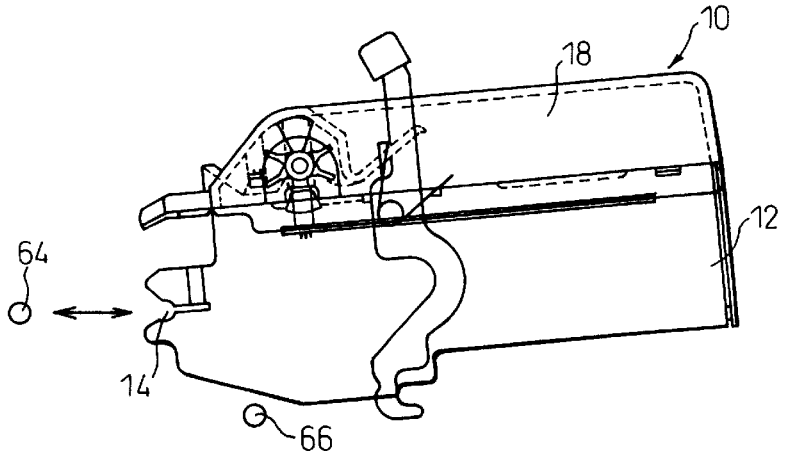

FIGS. 3A to 3C show the manner in which the sheet supply apparatus 10 is removed from the printer 50. As shown in FIG. 3A, the stud 64 is fitted in the mounting recess 14, and the stud 66 is fitted in the mounting recess 16, whereby the sheet supply apparatus 10 is mounted to the printer 50. Also, a lock lever 19*a* is mounted on the lateral portion of the apparatus for preventing upward removal. For removing the sheet supply apparatus 10 from this state, as shown in FIG. 3B, the front end portion of the sheet supply apparatus 10 is lifted up around the stud 64 as a supporting point, and thus the stud 66 is separated from the mounting recess 16. Then, as shown in FIG. 3C, the sheet supply apparatus 10 is pulled out to the front side. The stud 64 leaves the mounting recess 14. The lock lever 19*a* is a mechanism rotated around a rotational supporting point 19*b*. Under the condition of FIG. 19A, the apparatus is locked by a mechanism adapted to apply tension in the direction 19*e* by a torsion spring 19*d*. The sheet supply apparatus 10 can be mounted to the printer 50 also reversely in accordance with the procedures shown in FIG. 3C to FIG. 3A. As a result, the sheet supply apparatus 10 can be replaceably mounted to the printer 50.

Figure 4:
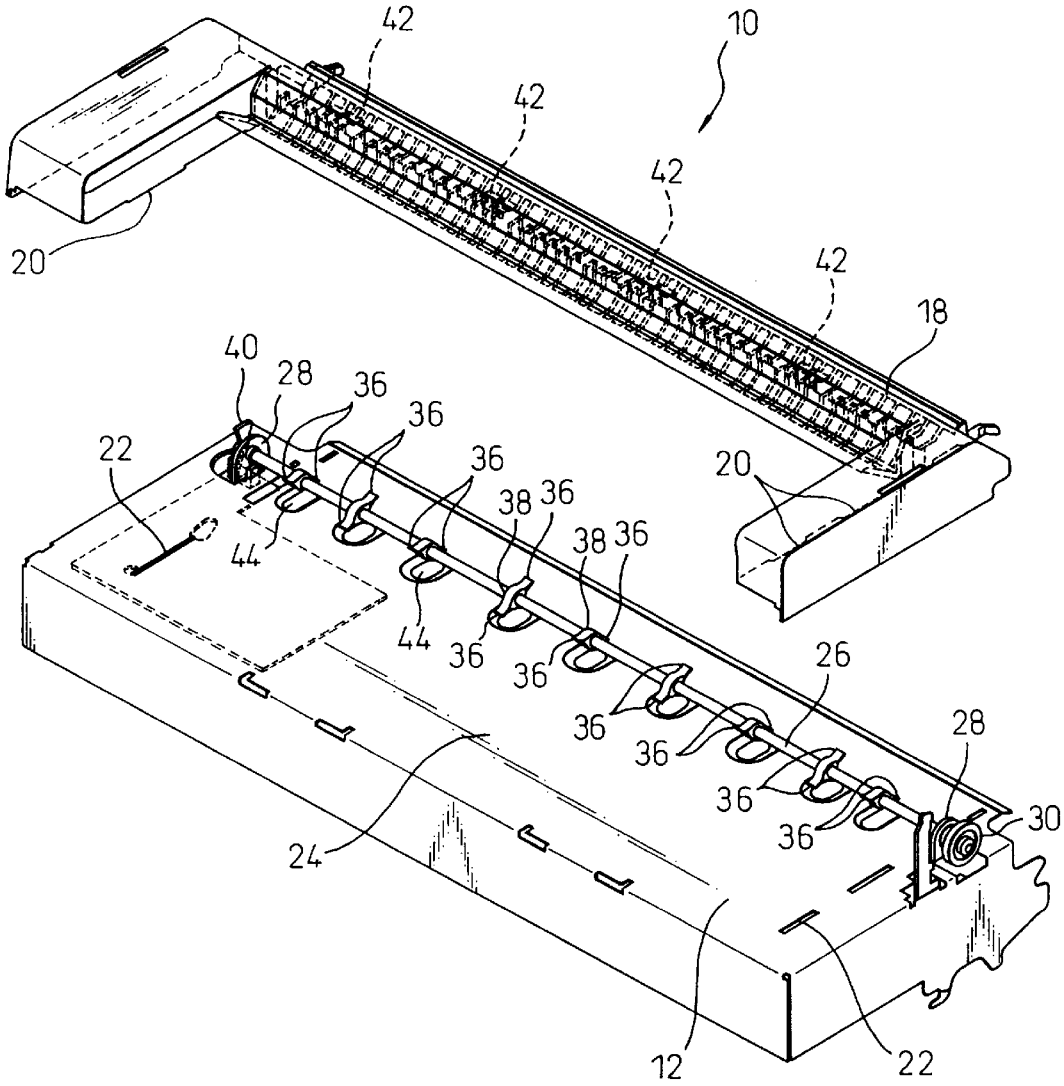
FIG. 4 is an exploded perspective view of the sheet supply apparatus in detail.
Figure 5:
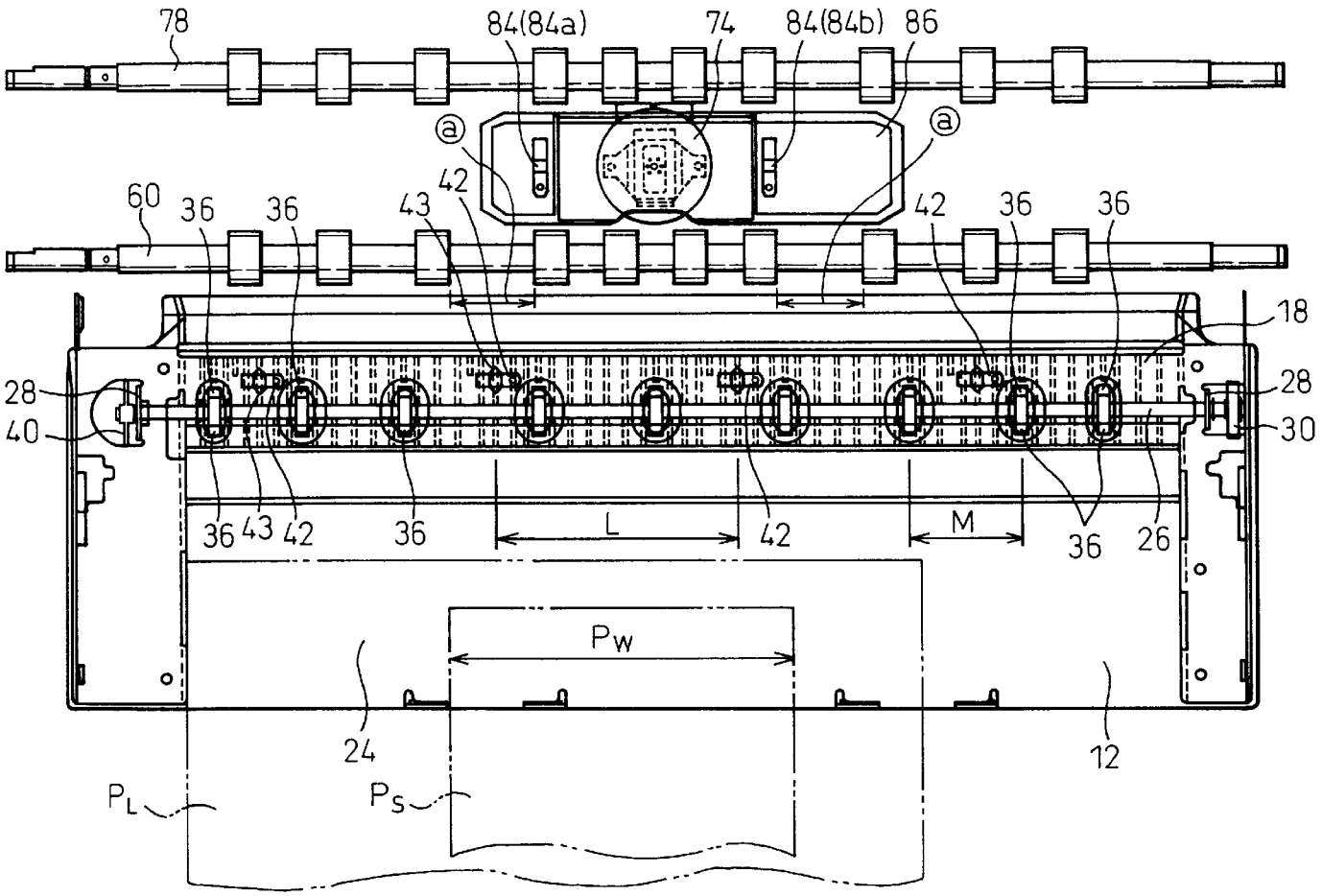
FIG. 5 is a plan view of the sheet supply apparatus.

FIGS. 4 and 5 show the sheet supply apparatus 10 in detail. The sheet supply apparatus 10 comprises a frame 12 and a cover 18 for covering the forward end portion of the frame 12. The cover 18 can be attached to the frame 12 by fitting the lower end portions of the vertical walls 20 of the cover 18 in slits 22 of the frame 12. The upper wall of the frame 12 is substantially flat and forms the sheet conveyance surface 24.

Figure 9:
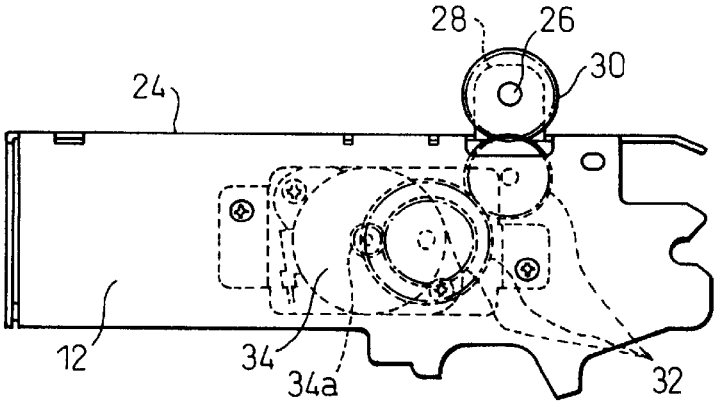
FIG. 9 is a view showing the rotating unit for the shaft of the sheet supply apparatus.

A supply shaft 26 is arranged rotatably above the sheet conveyance surface 24, and is supported on the frame 12 by vertical supports 28 having bearings. As shown in FIG. 9, a gear 30 is mounted at an end of the supply shaft 26. This gear 30 is connected to a motor gear 34*a* of a supply motor 34 through a gear train 32 arranged below the sheet conveyance surface 24. The supply motor 34 is supported by the frame 12. Thus, the supply shaft 26 can be rotated by the supply motor 34.

As shown in FIGS. 4 and 5, a plurality of protrusions 36 are formed on the supply shaft 26 in an axially spaced relationship and at circumferentially different angles. These protrusions 36 are formed as lobes of configured rollers 38 each having a hub held on the supply shaft 26 and at least one lobe protruded from the hub. According to this embodiment, nine configured rollers 38 are arranged on the supply shaft 26. Each configured roller 38 has two lobes extending in opposed relationship to each other from the hub along the diametrical direction of the shaft 26.

Figure 7:
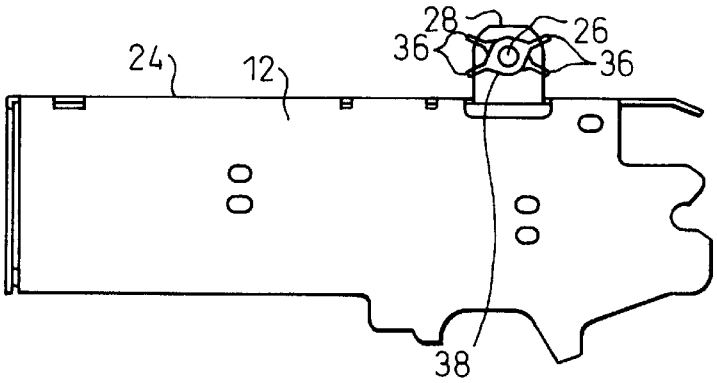
FIG. 7 is a side view of the frame of the sheet supply apparatus for showing the protrusions mounted to the shaft.

FIG. 7 is a side view as taken from lateral side of the frame 12 for showing the protrusions 36 mounted on the supply shaft 26. The protrusions 36 opposed to each other in the diametrical direction of the supply shaft 26 are arranged within the angular range of about 50 degrees, and no protrusion 36 exists in the angular range of 130 degrees which is the complementary angle to 50 degrees. With respect to the protrusions 36 of a given configured roller 38 on the shaft 26, the protrusions 36 of the next configured roller 38 are located at positions turned by 50 degrees clockwise, and the protrusions 36 on the second next configured roller 38 are located at positions turned by 50 degrees counterclockwise. In FIG. 7, none of the protrusions 36 is in contact with the sheet on the sheet conveyance surface, and under this condition, the sheet receives no conveyance force. The supply shaft 26 has an angular range in which none of the protrusions 36 is in contact with the sheet on the sheet conveyance surface 24.

Figure 8:
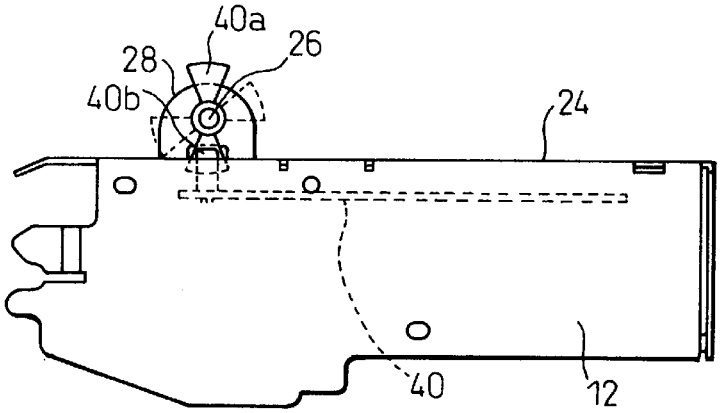
FIG. 8 is a side view of the frame of the sheet supply apparatus for showing the phase sensor.

In FIGS. 4 and 5, a phase sensor 40 is disposed at an end portion of the supply shaft 26 far from the end portion for mounting the gear 30 of the supply shaft 26. FIG. 8 is a side view taken from the other side from FIG. 7 for showing the phase sensor 40. The phase sensor 40 includes a fan-shaped twin-headed sensor lever 40*a* mounted on the supply shaft 26, and an optical detector 40*b* fixed to the frame 12. The optical detector 40*b* includes a light emitting portion and a light receiving portion. Each time the sensor lever 40*a* passes through a gap between the light emitting portion and the light receiving portion, the light path is shut off and the optical detector 40*b* generates a signal.

Figure 6:
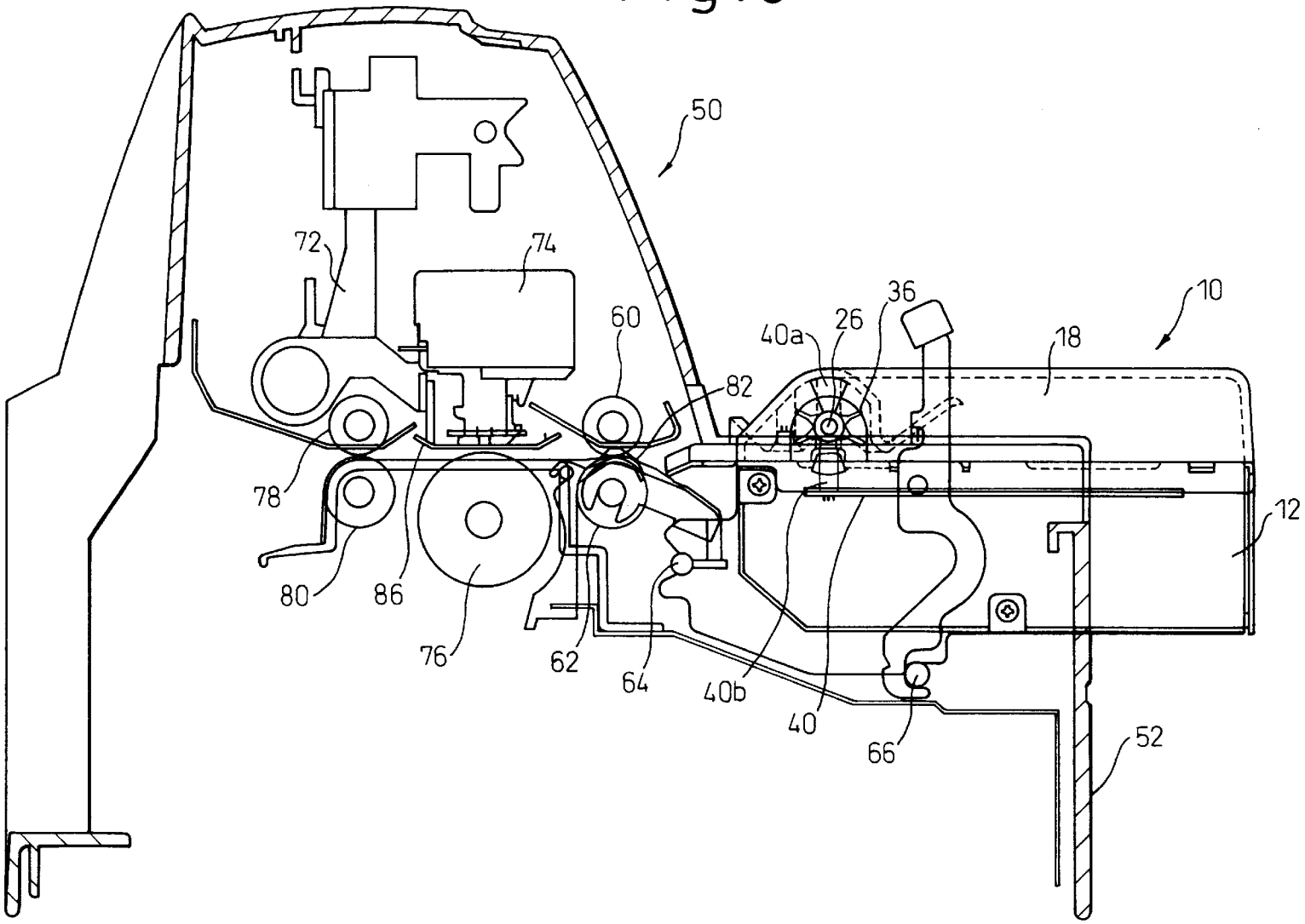
FIG. 6 is a cross-sectional view of the printer with the sheet supply apparatus mounted thereto.

The protrusions 36 and the phase sensor 40 are shown separately from each other in FIGS. 7 and 8, but the protrusions 36 and the phase sensor 40 are both visible when the frame 12 is viewed from the transverse direction, as shown in FIG. 6. The protrusions 36 and the sensor lever 40*a* of the phase sensor 40 are mounted on the supply shaft 26 at substantially the same angular phase.

Further, the sheet supply apparatus 10 includes a plurality of supply sensors 42 arranged along a line parallel to the supply shaft 26 at a position beyond the supply shaft 26. Each supply sensor 42 is a reflection-type sensor including a light emitting portion and a light receiving portion and is mounted to the cover 18. The portion of the frame 12 located below each supply sensor 42 has a hole 43. In absence of paper, the light receiving portion fails to react due to provision of the hole 43 in the frame 12. In presence of paper, on the other hand, the emitted light is reflected by the paper and the light receiving portion reacts to the reflected light.

Figure 10:
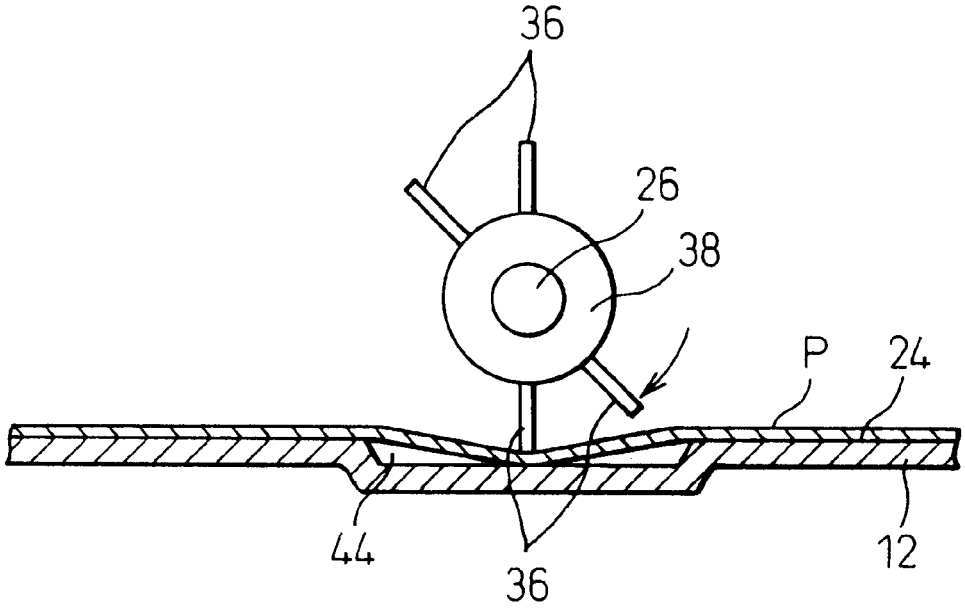
FIG. 10 is a cross-sectional view showing the shaft with a plurality of protrusions and the sheet conveyance path.

Further, the sheet conveyance surface 24 has depressions 44 corresponding to the positions of the protrusions 36. As shown in FIG. 10, the forward end of each protrusion 36 enters into a corresponding depression 44, so that the sheet P supplied onto the sheet conveyance surface 24 is conveyed by the protrusions 36 while being deformed slightly in the depressions 44 by being pushed by the protrusions 36. The force of the protrusions 36 to convey the sheet P is different, depending on the thickness of the sheet P. When conveying a thin single sheet, for example, the sheet P is easily deformed in the depressions 44, so that the protrusions 36 softly contact the sheet P and convey it with a weak feeding force. When conveying a thick single sheet or vouchers including a plurality of sheets, on the other hand, the sheet P is not easily deformed in the depressions 44, so that the protrusions 36 strongly contact the sheet P and convey the latter with a strong feeding force.

In FIG. 5, the sheet supply apparatus 10 can be mounted also to a printer 50 which had been shipped previously, and therefore, the shaft 26 of the sheet supply apparatus 10 is arranged in a predetermined relationship to the sheet conveyance rollers 60 of the printer 50.

The sheet supply apparatus 10 is designed such that a large sheet $P_L$ and a small sheet $P_S$ can be set at a desired position over the whole area of the sheet conveyance surface 24 (randomly set). In the example shown in FIG. 5, the large sheet $P_L$ is usually placed at a position slightly leftward as in the ordinary printer, while the small sheet $P_S$ is located at the central position. The usable minimum sheet width PW is stated in the specification of the sheet supply apparatus 10. In FIG. 5, the width of the small sheet Ps is indicated as the minimum sheet width PW. In the case where the width of the sheet used is larger than PW, that sheet is supplied to the printer 50 by the sheet supply apparatus 10 and inclined feeding thereof is automatically corrected during supply to the printer 50.

The interval L of the supply sensors 42 in the axial direction of the shaft 26 is not more than PW (L<PW). Therefore, wherever the sheet Ps with a small minimum width is set on the sheet conveyance surface 24, presence or absence of that sheet is detected by at least one of the supply sensors 42. Also, the protrusions 36 arranged on the shaft 26 of the sheet supply apparatus 10 have intervals M of not more than ½ PW (M<½ PW) in the axial direction of the shaft 26. As a result, at least two protrusions 36 can engage the sheet and inclined feeding of the sheet is corrected, causing the sheet to abut against the sheet conveyance rollers 60 and 62.

FIG. 6 is a cross-sectional view of the printer 50 with the sheet supply apparatus 10 mounted thereto. The printer 50 includes a movable carrier 72, a printing head 74 mounted to the carrier 72, a platen 76 opposed to the printing head 74, a pair of sheet conveyance rollers 60 and 62 arranged on one side of the platen 76, and a pair of sheet conveyance rollers 78 and 80 arranged on the other side of the platen 76. Further, the printer 50 includes the sheet supply apparatus 10 described above. In this patent application, the sheet supply apparatus 10 cooperates with a pair of the sheet conveyance rollers 60 and 62 located in the vicinity thereof.

Figure 11:
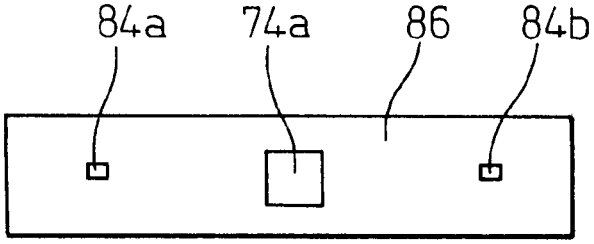
FIG. 11 is a view showing the carrier having the printing head and two sheet upper end sensors.

Also, the carrier 72 has a sheet guide 86 opposed to the platen 76. As shown in FIGS. 5 and 11, a pair of sheet upper end sensors 84 (84*a*, 84*b*) are mounted to the sheet guide 86. The sheet guide 86 has a hole 74*a* at the center thereof allowing the printing pins of the printing head 74 to pass therethrough, and a pair of the sheet upper end sensors 84 are disposed on both sides of and at equal distance from the hole 74*a*. The two sheet upper end sensors 84 and the hole 74*a* are arranged on a line perpendicular to the sheet conveyance direction. The two sheet upper end sensors 84 can detect the arrival of the upper end of the sheet at the position of the printing head 74 and the inclined feeding of the arriving sheet.

Figure 12A:
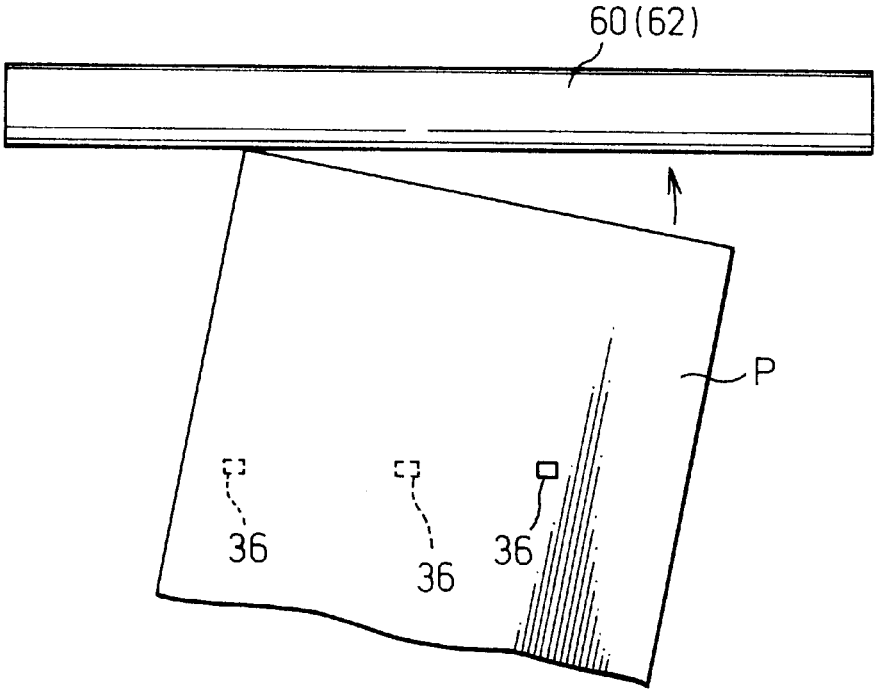
FIGS. 12A and 12B are views explaining the principle of correcting inclined feeding of the sheet.
Figure 12B:
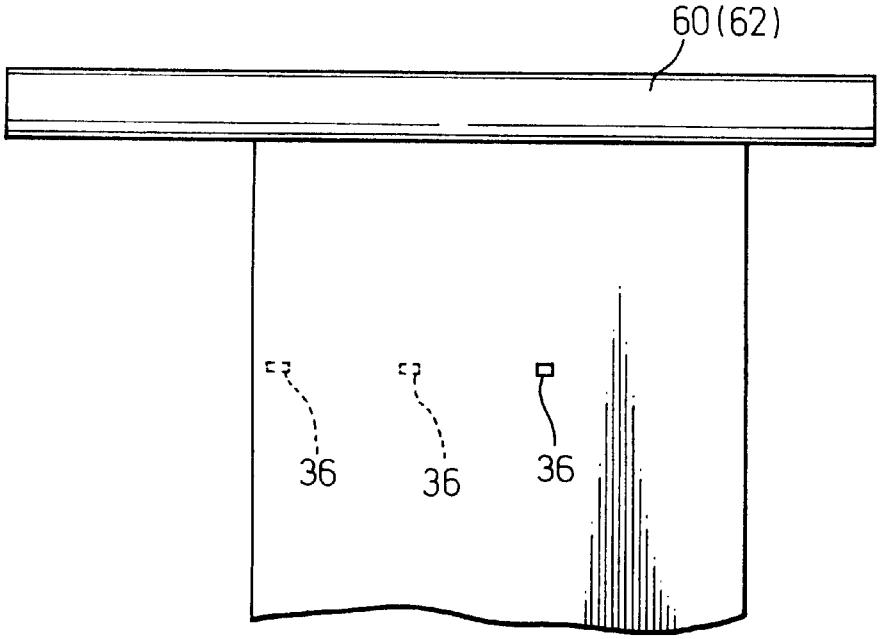

Now, the operation of the sheet supply apparatus 10 will be explained with reference to FIGS. 12A and 12B.

The rotatable supply shaft 26 having a plurality of protrusions 36 conveys the sheet P toward (the nips of) the sheet conveyance rollers 60 and 62 in response to the output of the supply sensors 42. In this case, the sheet P is conveyed only by the friction force of the protrusions 36 mounted to the supply shaft 26.

In the case where the sheet P is supplied in the inclined position, one side edge of the upper end of the sheet P (the left edge of the leading side of the sheet in the direction of conveyance, for example) comes into contact with or abuts against the stationary sheet conveyance rollers 60 and 62. When one end of the sheet abuts against the sheet conveyance rollers 60 and 62 that end of the sheet P is stopped and the other portion of the sheet continues to be conveyed by the protrusions 36 of the supply shaft 26. Thus, the sheet P rotates about the stationary end (FIG. 12A), and inclined feeding of the sheet P is corrected (FIG. 12B). In this case, even if a plurality of the protrusions 36 may be in contact with the sheet P, the action of rotating the sheet P is mainly effected by the protrusion 36 located far from the end of the sheet P in contact with the sheet conveyance rollers 60 and 62 (which is indicated by solid line, while the other protrusions 36 are indicated by chains). The protrusions 36 engage the sheet P substantially by point contact, and therefore the sheet P easily and positively rotates to thereby correct the inclined feeding thereof. In the case where the sheet is conveyed by being held with a pair of pinch rollers, in place of the protrusion 36 indicated by solid lines, the sheet continues to be conveyed in the inclined position and fails to rotate in the desired way.

Figure 13:
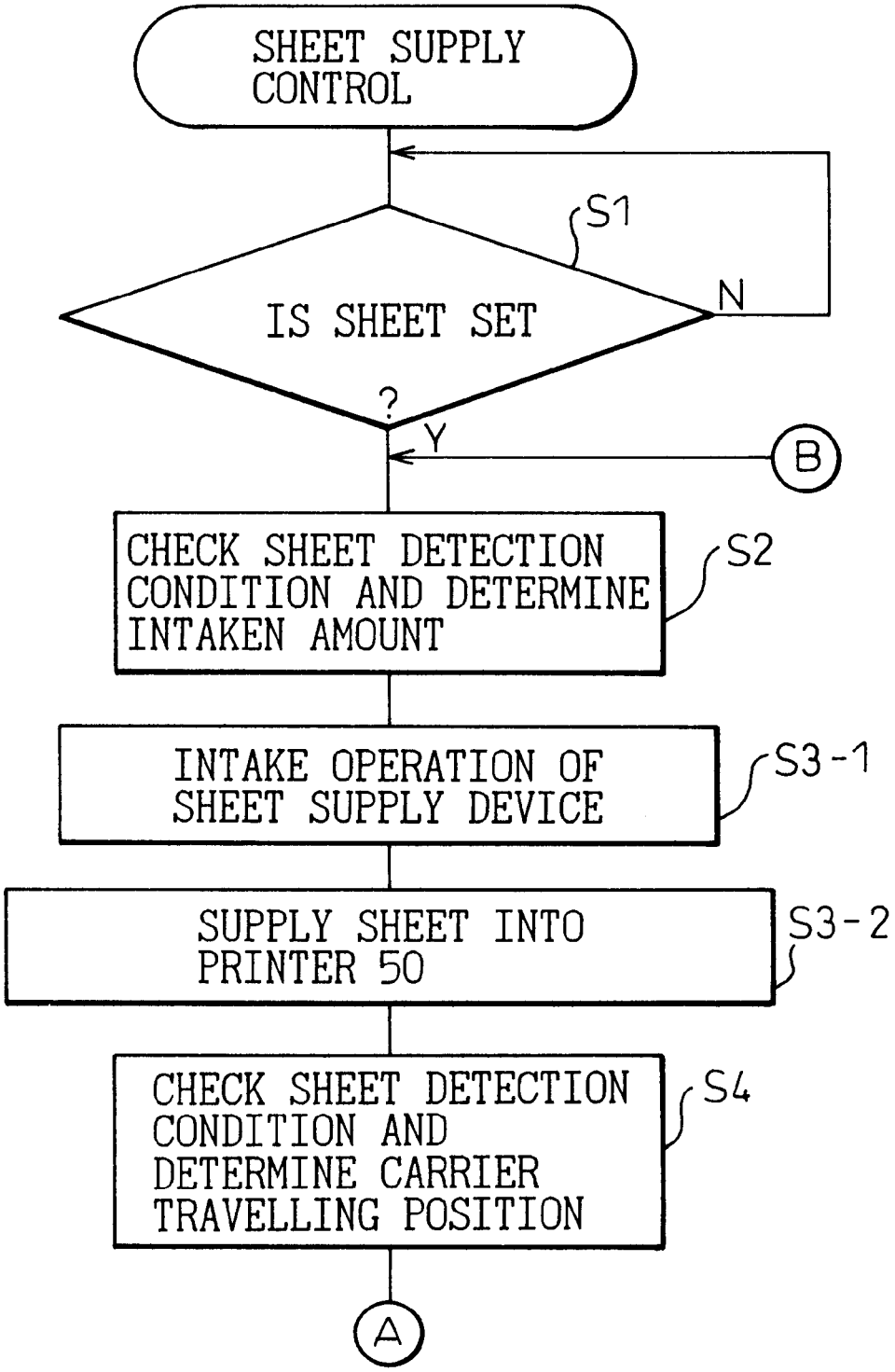
FIG. 13 is a flowchart for controlling the sheet supply apparatus.

The operation of the sheet supply apparatus 10 and the printer 50 will be now explained with reference to FIGS. 13 to 15. FIG. 13 is a flowchart showing the operation of the sheet supply apparatus 10, and FIGS. 14 and 15 flowcharts showing the operation of the printer 50.

In FIG. 13, step S1 judges whether the sheet is set on the sheet conveyance surface 24 or not. Since a plurality of supply sensors 42 are arranged at predetermined intervals, the presence or the absence of a randomly-set sheet can be accurately detected. Upon detection that the sheet is set, step S2 checks the sheet detection condition and determines the intake amount. The sheet detection condition is checked to determine which supply sensor(s) 42 has detected presence of a sheet, and according to the result, the intake amount is determined in a manner as shown in FIG. 16, for example.

In FIG. 16, in the case where only one supply sensor 42 has detected the presence of a sheet, the number of intake steps is set to N1 as the intake amount. The number of intake steps is the number of steps in which the motor for driving the shaft 26 of the sheet supply apparatus 10 operates. In the case where two supply sensors 42 have detected the presence of a sheet, on the other hand, the number of intake steps is set to N2-X1. In the case where three supply sensors 42 have detected the presence of a sheet, the number of intake steps is set to N3-X2. In the case where four supply sensors 42 have detected the presence of a sheet, the number of intake steps is set to N4-X3. In this example, N1 is the maximum and the number of intake steps decreases sequentially.

Then, in step S3-1, the shaft 26 is driven to perform the intake operation of the sheet supply apparatus 10. This intake operation, as described above, is for conveying the sheet toward the sheet conveyance rollers 60 and 62, so as to cause the sheet to abut against the sheet conveyance rollers 60 and 62, to thereby correct the inclined feeding thereof. N1 represents the maximum number of intake steps, and N4-X3 the minimum number of intake steps. This is for the following reason. In the case where the number of the supply sensors 42 that have detected presence of a sheet is small, i.e. in the case where the sheet width is small (such as a postcard with letters written vertically), a smaller number of protrusions contact the sheet and the conveyance amount of the protrusions of the shaft 26 is decreased. In such a case, the correction of inclined feeding is relatively difficult and the sheet is liable to be set inclined, and therefore the number of intakes steps is set to a large value. In the case where the number of the supply sensors 42 that have detected presence of a sheet is large, i.e. in the case where the sheet width is large, on the other hand, the conveyance amount of the protrusions 36 of the shaft 26 increases. In such a case, the correction of the inclined feeding is relatively easy and the sheet is not easily set inclined. Therefore, the number of intake steps is set to a small value. If the number of intake steps is set to a larger constant value, no problem is posed at the sacrifice of a reduced throughput. In the case where the number of intake steps is set to a smaller constant value in order to improve the throughput, on the other hand, a narrow sheet can be taken in with insufficient correction of the inclined feeding.

When the rotation of the shaft 26 is completed, the sheet is supplied into the printer 50 so that the upper end of the sheet is pinched by the sheet conveyance rollers 60 and 62 of the printer 50 in step S3-2 and the sheet is fixed at the sheet conveyance rollers 60 and 62 of the printer 50. Then, in order to check the sheet detection condition in step 4, the shaft 26 of the sheet supply apparatus and the conveyance rollers 60 and 62 are operated by a predetermined amount at the same time.

After the rotation of the shaft 26 and the conveyance rollers 60 and 62, the sheet detection condition is again checked at step S4 and the carrier travel position is determined. The carrier travel position is shown in FIG. 17, for example. The reason why the sheet detection condition is checked again after the rotation of the shaft 26 is that the sheet detection condition may be different between the time point when the sheet is set and the time point when the rotation of the shaft 26 ends.

In FIG. 17, the four supply sensors 42 are designated by reference numerals PSS1 to PSS4. In the case where the four supply sensors 42 are OFF as in the case of NO.1, the carrier 72 is set to take a position of a single sheet intake position (cut sheet intake position assigned for the printer itself). In the case where any one of the supply sensors 42 is ON as in Nos. 2, 3, 5 and 9, on the other hand, the left one (84*a*) of the sheet upper end sensors 84 of the carrier 72 is set to take a position on an extension of that particular supply sensor 42. In the case where two or more supply sensors 42 are turned ON successively as in Nos. 4, 7, 8, 13, 15 and 16, the carrier 72 is set to take the central position on the extensions of the particular supply sensors 42. In the case where two or more supply sensors 42 are discretely turned on as in Nos. 6, 10, 11, 12 and 14, it is determined that an error has occurred, and the carrier 72 is set to the cut sheet intake position.

Figure 14:
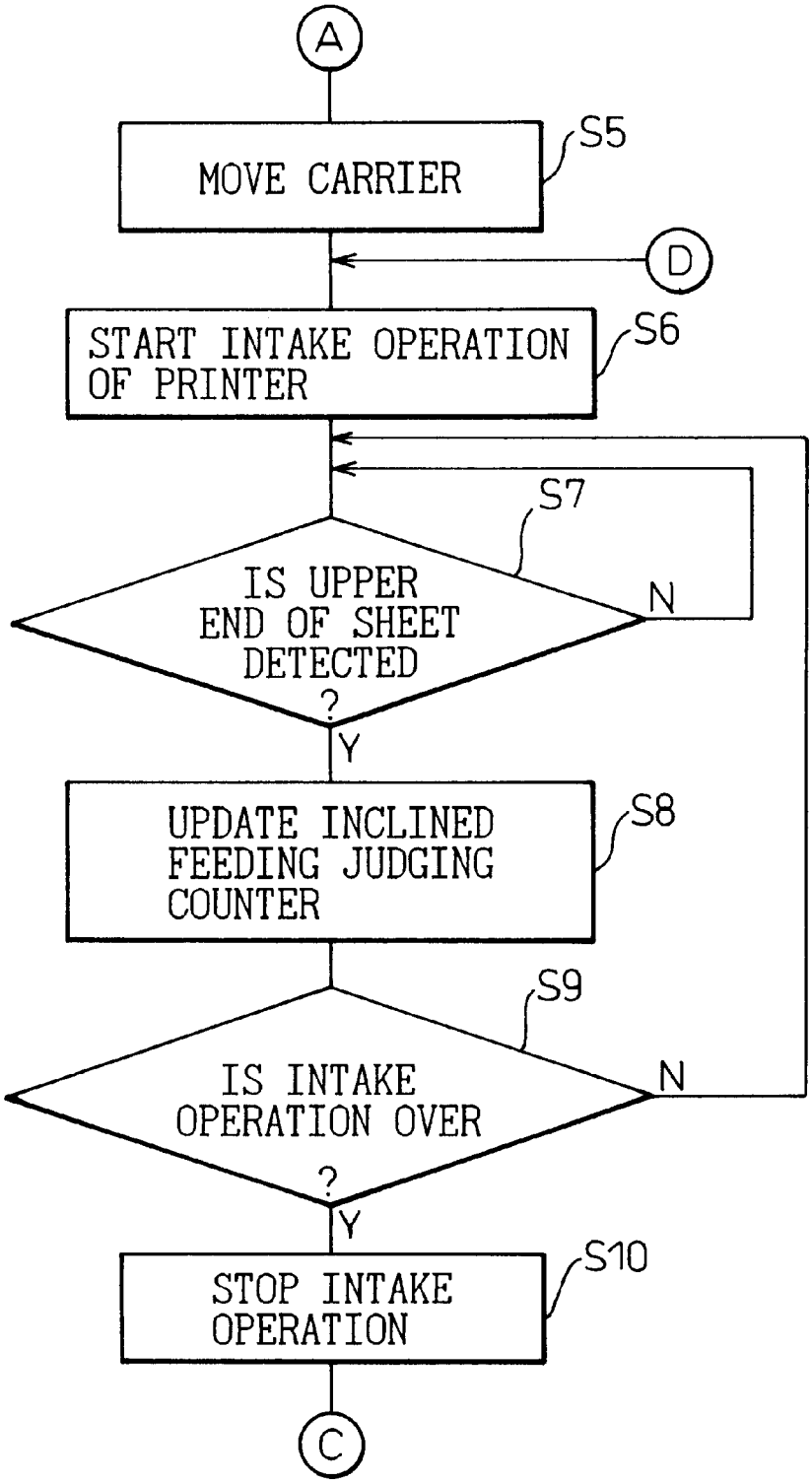
FIG. 14 is a flowchart continued from FIG. 13 for controlling the printer.
Figure 15:
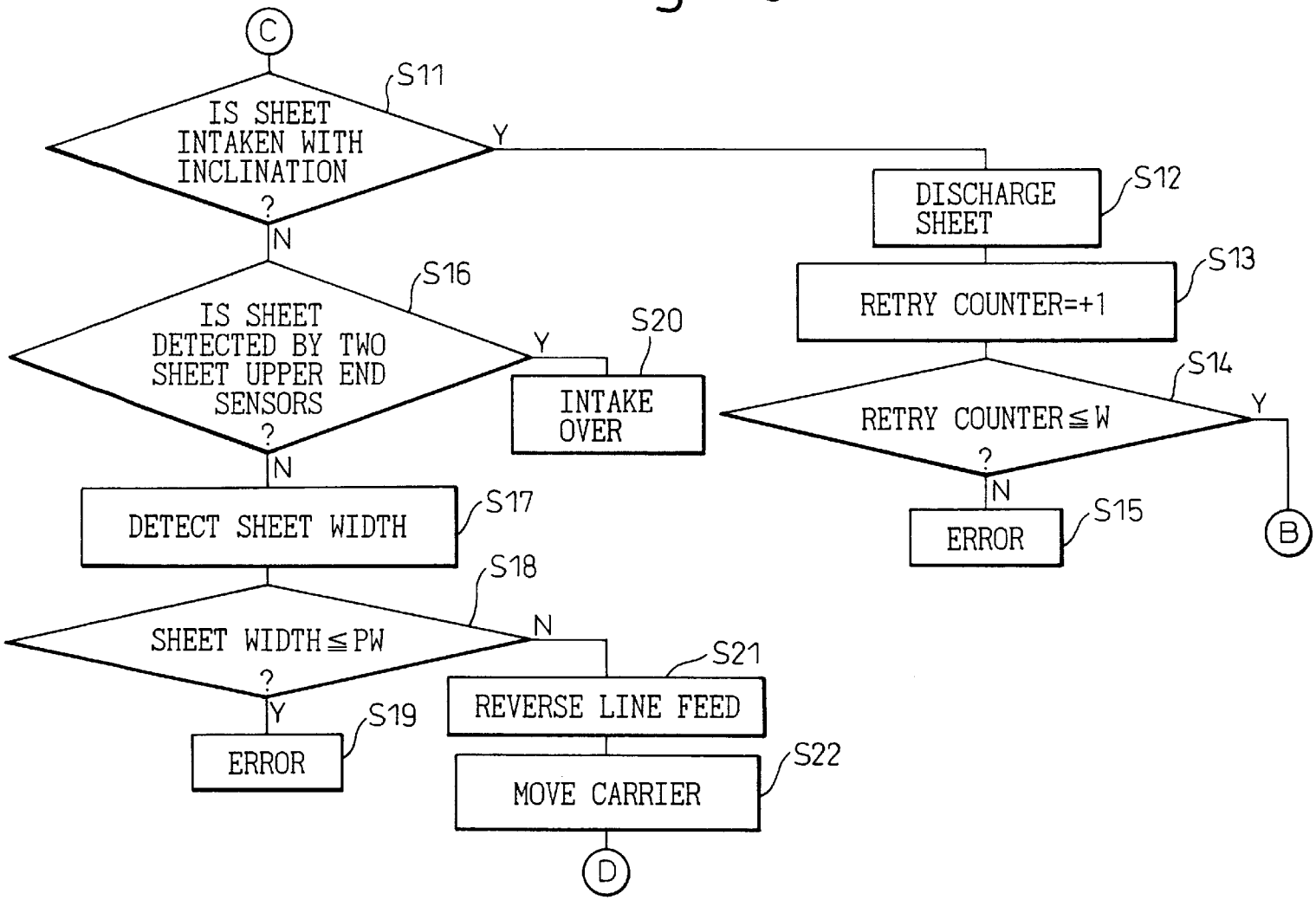
FIG. 15 is a flowchart continued from FIG. 14 for controlling the printer.

In FIG. 14, the carrier 72 is moved to the previously set position in step S5. In the case of No.2 in FIG. 17, for example, the carrier 72 is moved so that the left side sensor (84*a*) of the sheet upper end sensors 84 of the carrier 72 (sheet guide 86) comes on the position on an extension of the leftmost supply sensor 42 in FIG. 5. In other words, since a small sheet is set in the extreme left position in this case, the carrier 72 is set to the position corresponding to this sheet in advance.

In step S6, the intake operation of the printer 50 is started. In step S7, it is judged whether the upper end of the sheet has been detected or not. The upper end of the sheet is detected by two sheet upper end sensors 84. Then, in step S8, an inclined feeding judgment counter is updated.

Figure 18:
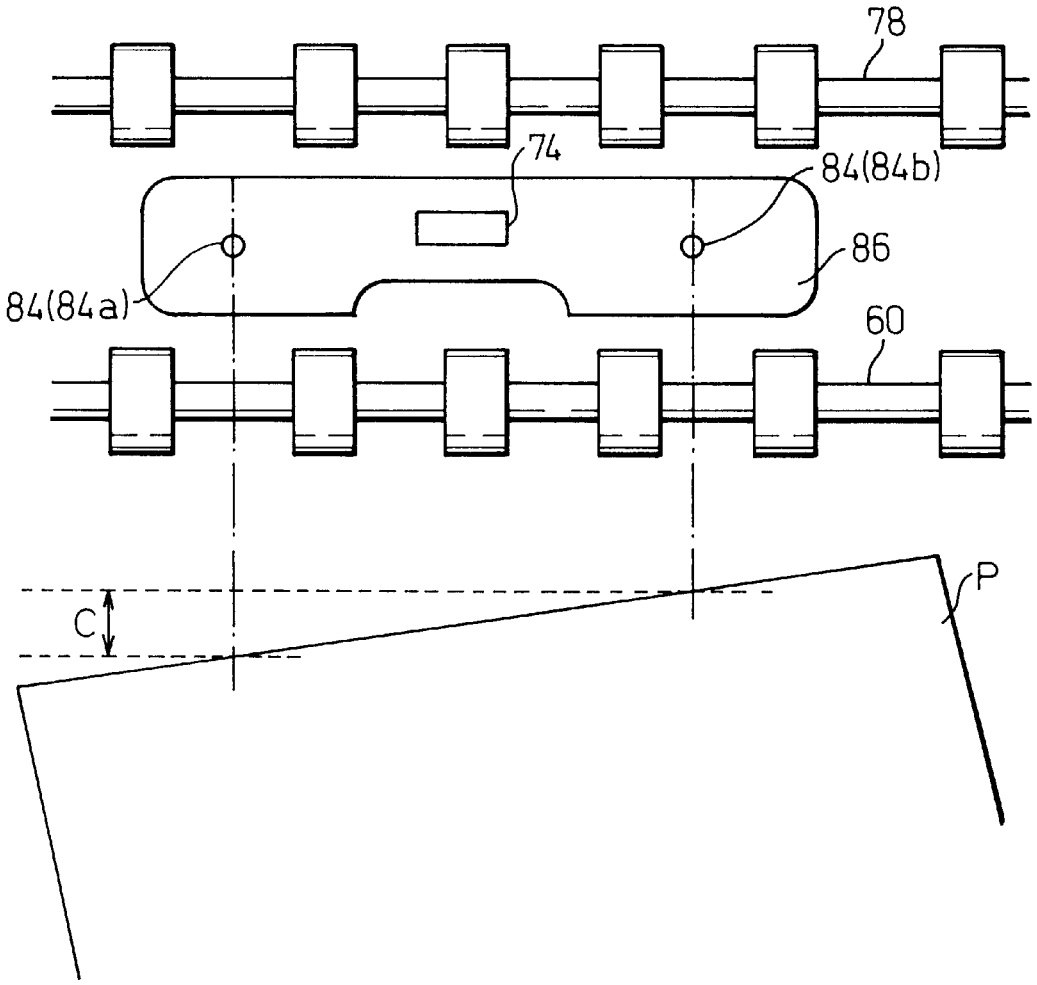
FIG. 18 is a view showing inclined feeding of the sheet.

As shown in FIG. 18, when one of the two sheet upper end sensors 84 is turned ON while the other sheet upper end sensor 84 is turned OFF, the sheet is traveling inclined, and the inclined feeding judgment counter (C) counts the on-off difference between the two sheet upper end sensors 84 as the number of steps and updates the count.

Figure 26:
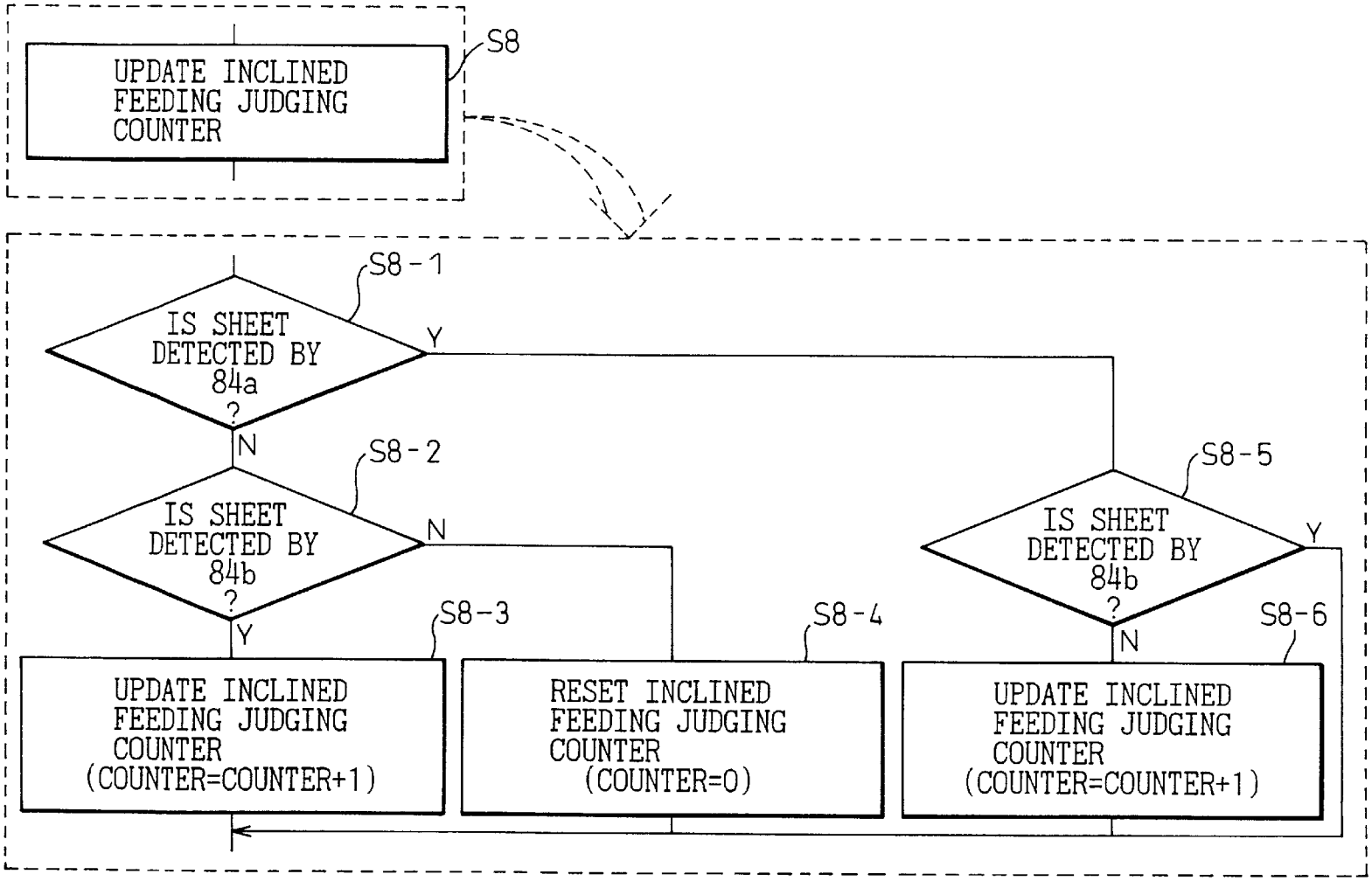
FIG. 26 is a flowchart for updating the diagonal travel judgment counter.

Step S8 will be further explained with reference to the flow shown in FIG. 26. First, in step S8-1, the state of the sensor 84*a* is checked and, in the absence of a sheet, the state of the sensor 84*b* is checked in step S8-2. Then, in the absence of a sheet, the inclined feeding judgment counter (C) is reset in step S8-4. In the case where the sensor 84*b* judges that the sheet is present in step S8-2, on the other hand, the inclined feeding judgment counter is updated as in step S8-3. In the case where the judgment in step S8-1 is the presence of a sheet, the state of the sensor 84*b* is checked in step S8-5. In the case where the judgment of the sensor 84*b* in step S8-5 is the absence of a sheet, the inclined feeding judgment counter is updated in step S8-6 in the same manner as in step S8-3. In the case where the judgment in step S8-5 is the presence of a sheet, the inclined feeding judgment counter is not changed but the process proceeds to step S9.

Step S9 judges whether the intake operation has ended or not. In the case where the intake operation has not ended, the process proceeds to step S7 while, if the intake operation has ended, the intake operation by the sheet conveyance rollers 60 and 62 is ended in step S10. Then, step S11 in FIG. 15 judges whether the sheet is taken in inclined or not. If the answer is YES, the process proceeds to step S12 in which the sheet is discharged to the sheet supply apparatus 10 for retrial. In other words, the sheet conveyance rollers 60 and 62 are rotated in reverse, and the shaft 26 of the sheet supply apparatus 10 is also rotated in reverse. As a result, the sheet is discharged from the printer 50 to the sheet supply apparatus 10. In the process, in order to separate the sheet positively from the sheet conveyance rollers 60 and 62, the sheet conveyance rollers 60 and 62 and the shaft 26 are rotated in the reverse direction by the number of steps for intake operation plus some amount.

In the process of the retrial, the retry counter is updated in step S13, followed by step S14 in which it is judged whether the count in the retry counter is smaller than a predetermined value W or not. In the case where the judgment in step S14 is YES, the shaft 26 of the sheet supply apparatus 10 is reversely rotated by a predetermined amount. As a result, the sheet is conveyed further away from the sheet conveyance rollers 60 and 62 by the protrusions 36 of the shaft 26. In this case too, inclined feeding of the sheet is corrected to some degree. Especially for the distance (a) in FIG. 5, in which the interval between the sheet conveyance rollers is so wide that the correction is difficult, the sheet supply protrusions 36 are set to the corresponding positions and angular phase so that inclined feeding may be corrected to some degree at the time of retrial discharge. Then, the program proceeds to step S2 in FIG. 13, where the supply and the correction of inclined feeding of the sheet are repeated. The shaft 26 is set in phase each time it stops, so that it is synchronized with the sheet conveyance rollers 60 and 62 the next time when it is driven. In the case where the judgment in step S14 is NO, on the other hand, the process proceeds to step S15 for an error judgment.

In the case where the judgment in step S11 is NO, the process proceeds to step S16 for judging whether the two sheet upper end sensors 84 have detected the upper end of the sheet or not. In the case where the judgment in step S16 is YES, the process proceeds to step S20 to judge that the sheet is not inclined and the sheet intake has ended, thereby setting the apparatus ready for the printing operation. In the case where the judgment in step S16 is NO, on the other hand, the process proceeds to step S17 for performing the operation of detecting the sheet width. Then, the process proceeds to step S18 for judging whether the sheet width is smaller than a set minimum value PW or not.

In the case where the judgment in step S18 is NO, the process proceeds to step S21 for reverse line feed by an amount equivalent to the length from the detection of the upper end of the sheet to the stop position of the sheet plus some amount. In step S22, the carrier 72 is moved to the center of the sheet width detected, and then the program returns to step S6 in FIG. 14 for repeating the upper end detection and inclined feeding detection. In other words, in the case where the sheet width is larger than a set minimum value PW, one of the two sheet upper end sensors 84 may not be located within the sheet width, and therefore the carrier 72 is moved to detect the upper end and the inclined feeding repeatedly. In the case where the judgment in step S18 is YES, the process proceeds to step S19 for judging an error since the sheet width is smaller than the set minimum value PW.

Figure 19:
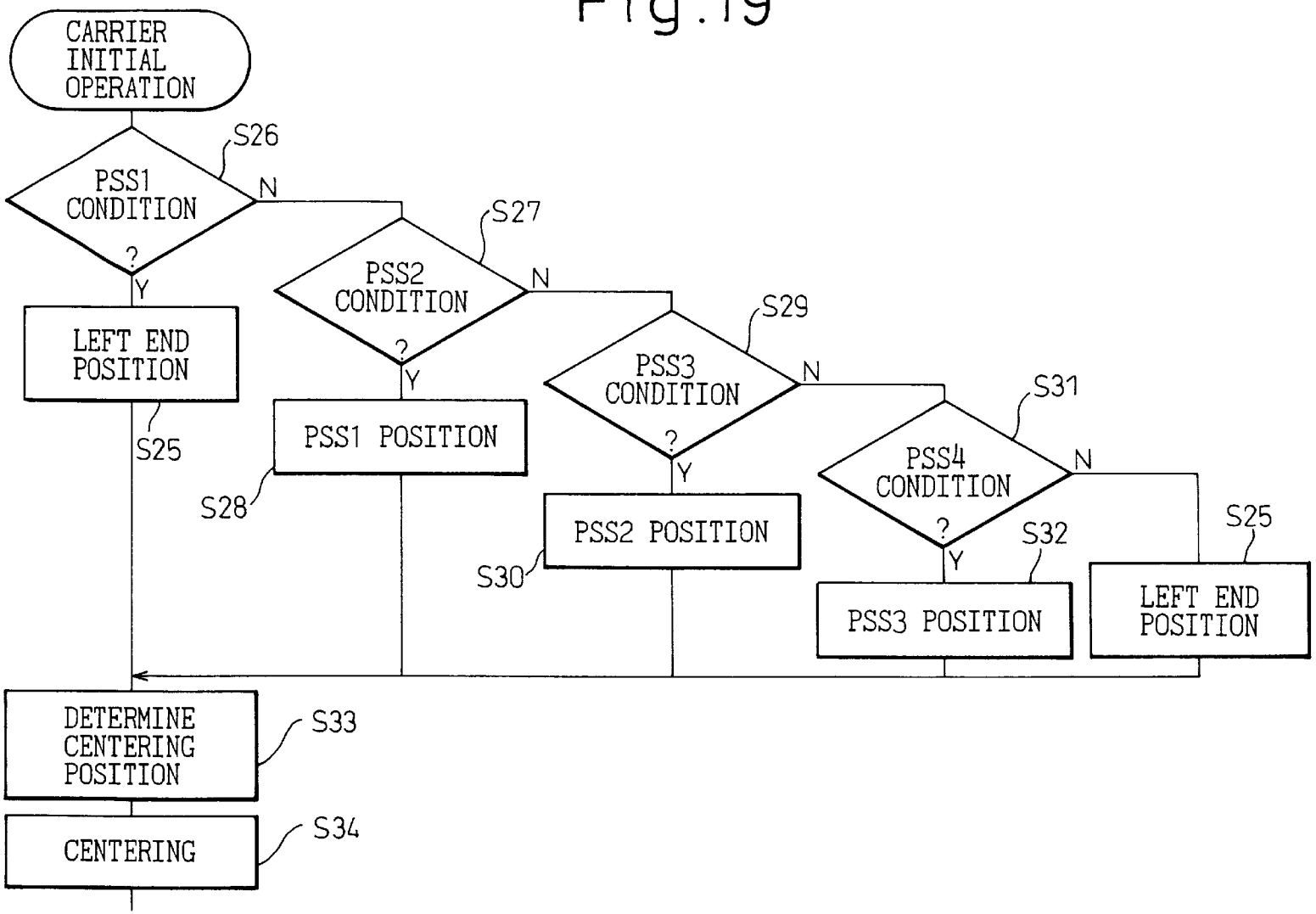
FIG. 19 is a flowchart showing the initial operation of the carrier for detecting the sheet width.

For detecting the sheet width in step S17, the carrier start position is determined as shown in the flowchart of FIG. 19. First, the process of steps S25 to S33 is performed for determining a target position of the carrier 72. According to this embodiment, the target position of the carrier 72 is set at a left position adjacent to the leftmost supply sensor 42 the signal of which is turned on among the four supply sensors 42, and step S33 determines the target position, followed by step S34 for centering the carrier 72 to the target travel position.

Figure 20:
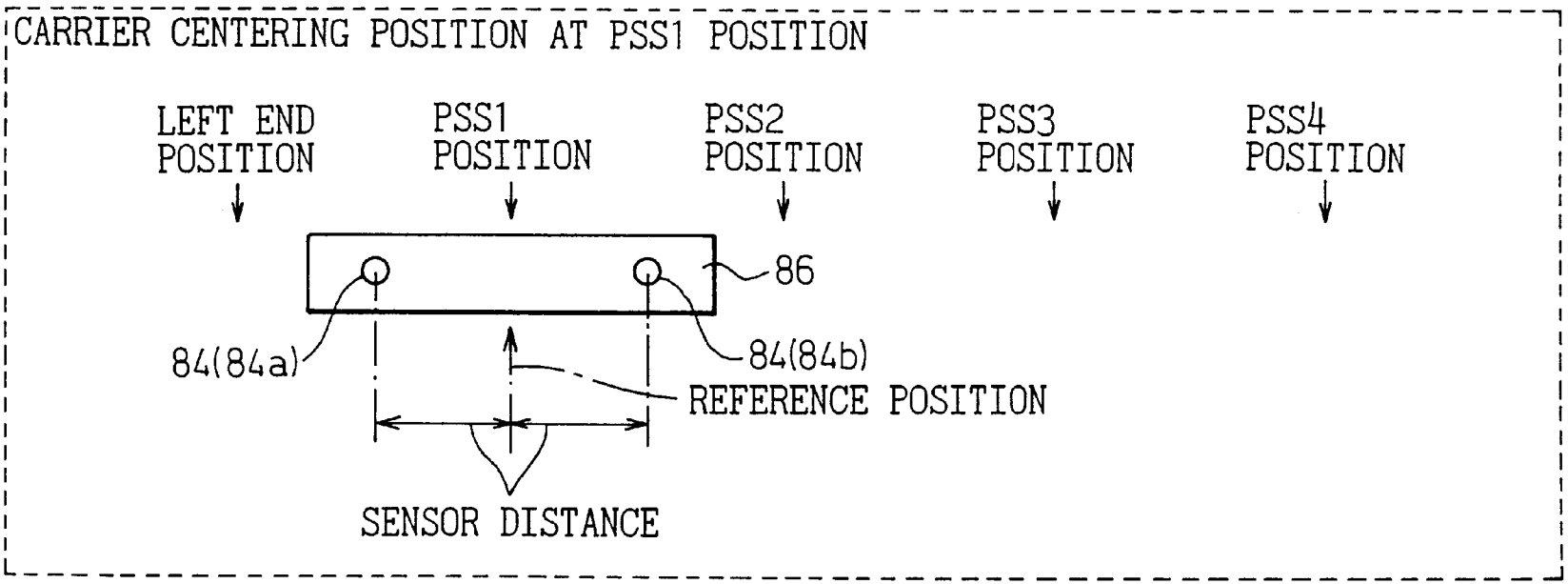
FIG. 20 is a diagram showing the centering in the initial operation of the carrier.

In the case where the judgment in step S26 is YES, for example, the signal of the leftmost supply sensor 42 is turned on, and therefore the target position of the carrier 72 is kept at the first left end. In the case where the judgment in step S27 is YES, the signal of the leftmost supply sensor 42 is off and the signal of the second leftmost supply sensor 42 is on. In step S28, therefore, the position of the leftmost supply sensor 42 is set as the target position of the carrier 72, and the carrier 72 is centered to the target position in step 34. This state is shown in FIG. 20.

Figure 21:
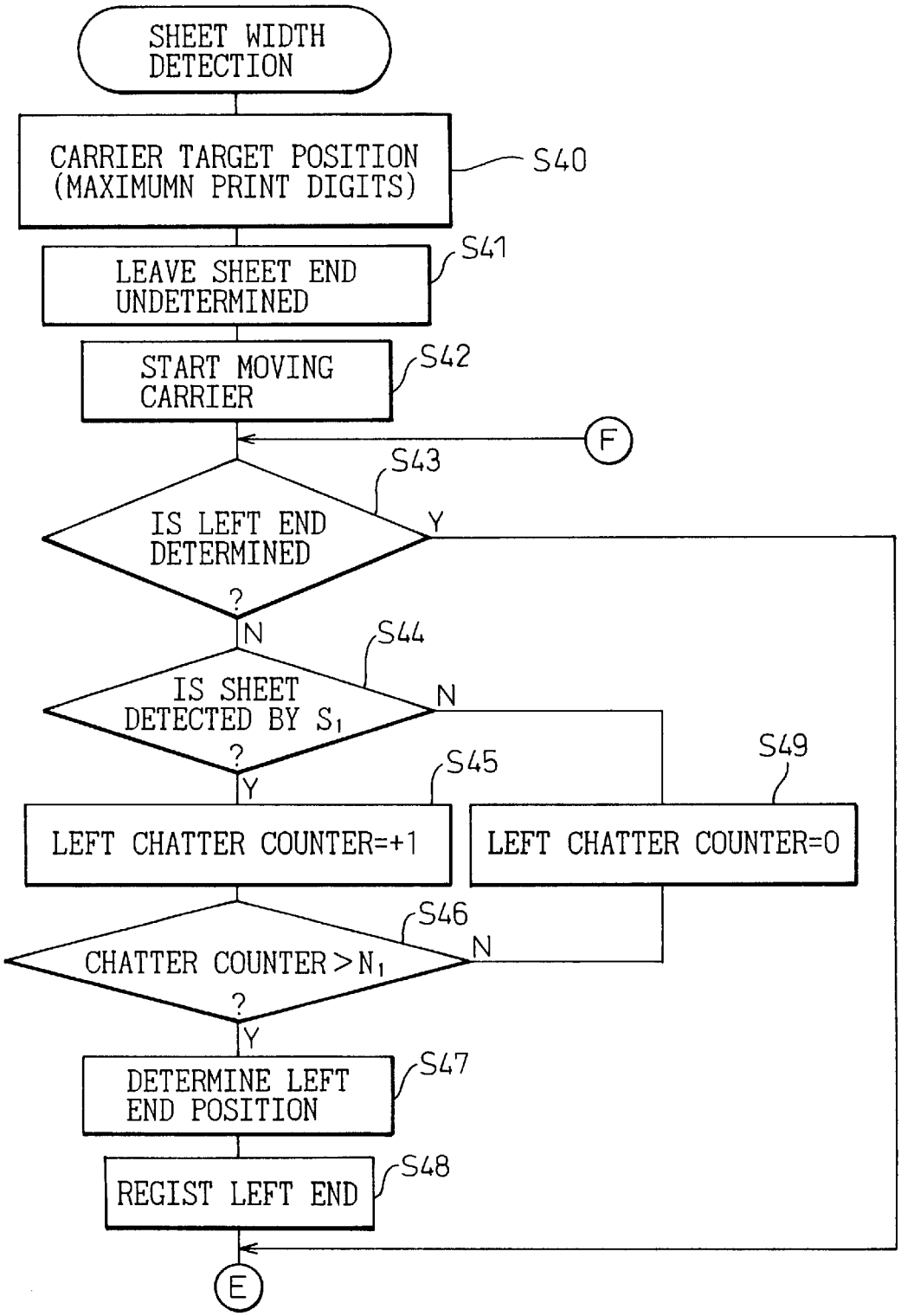
FIG. 21 is a flowchart for controlling the detection of the sheet width.
Figure 22:
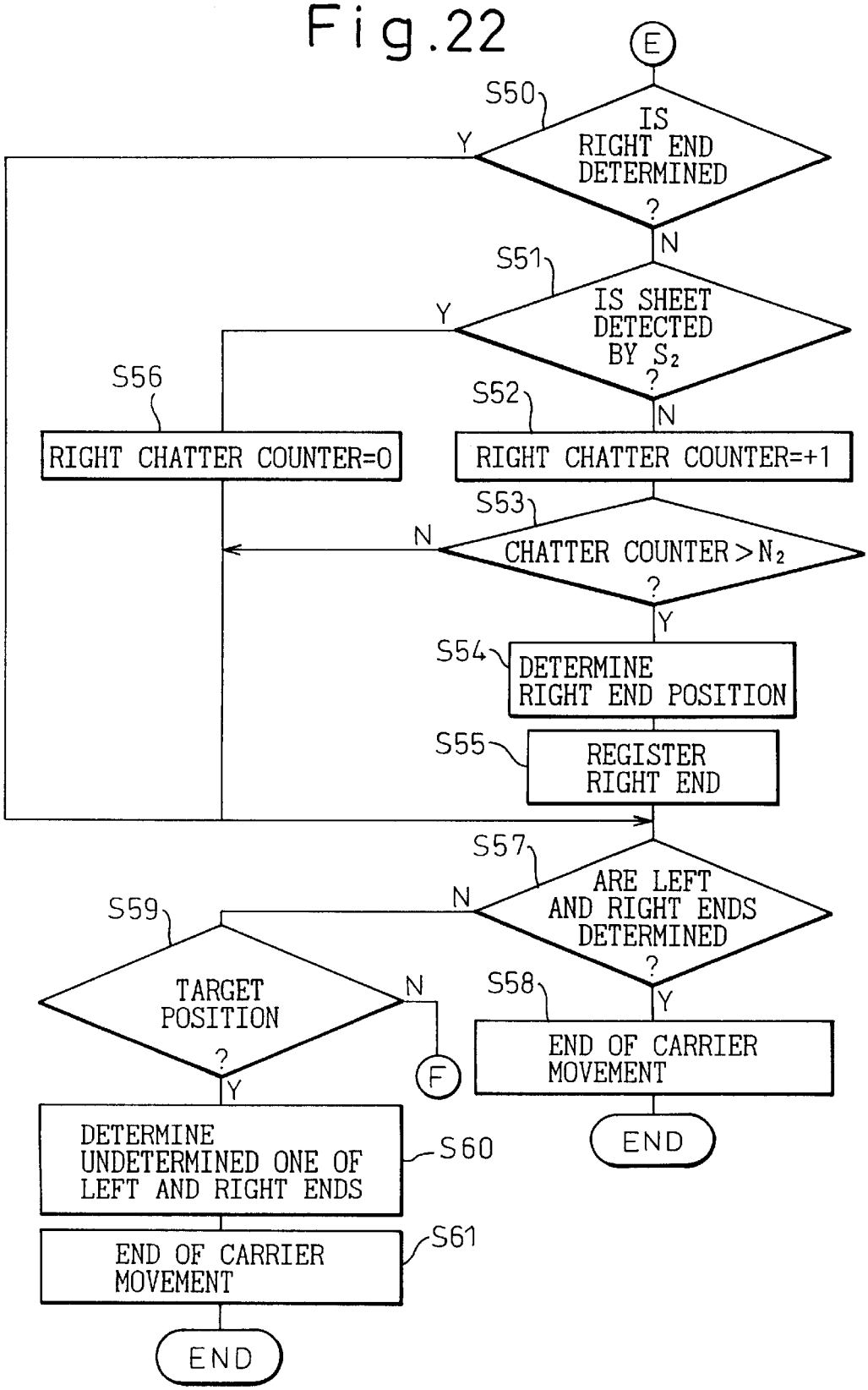
FIG. 22 is a flowchart continued for controlling the detection of the sheet width.

Also, in the case where the judgment in step S29 is YES, the third leftmost supply sensor 42 is turned on for the first time, and the position of the second leftmost supply sensor 42 is set as the target position of the carrier 72 in step S30. In similar fashion, in the case where the judgment in step S31 is YES, the fourth leftmost supply sensor 42 turns on for the first time. In step S32, therefore, the target position of the carrier 72 is set at the position of the third leftmost supply sensor 42. In this way, step S33 determines the target position of the carrier 86, and step S34 centers the carrier 72 at the target position. In the case of FIG. 20, for example, each position where the carrier 72 is centered is called the reference position, and the distance between a reference position and the sheet upper end sensor 84 is called the sensor distance. After the carrier 72 is centered, the sheet width can be detected by a simple operation of moving the carrier 72 from left to right as shown in FIGS. 21 and 22.

For sheet width detection, the carrier target position is first set in accordance with the maximum number of printing digits in step S40, followed by step S41 for leaving the sheet end surface undetermined. The reason is that it is judged whether the left and right ends of the sheet have been detected (step S57) to stop the carrier 72 even before reaching the target position when the left and right ends of the sheet are detected. Initially, therefore, the sheet end surface is left undetermined. Then, in step S42, the carrier 72 starts to move from left to right. In step S43, it is judged whether the left end has been determined. In the case where the judgment in step S43 is NO, step S44 judges whether the sheet is detected by the left sheet upper end sensor (S1) 84 or not.

In the case where the judgment in step S44 is NO, the left chucker counter is reset to zero in step S49. If the judgment in step S44 is YES, the count on the left chucker counter is incremented by one in step S45. Step S46 judges whether the count on the left chucker counter is larger than a reference value N1, and if the result is YES, step S47 determines the left end position of the sheet, followed by step S48 for judging that the left end has been determined.

The left end position is given as (reference position of carrier 72−sensor distance−count on left chucker counter). The carrier 72 continues to move from step S42, and the reference position of the carrier 72 is kept updated. The reference position of the carrier 72 used in this case includes the distance covered by the left sheet upper end sensor 84*a* until it moves across the left end of the sheet from the position on the left side of the left end of the sheet. The count on the left chucker counter is set negative in order to return to the position where the left end of the sheet is detected for the first time by the left sheet upper end sensor 84*a*.

Then, step S50 in FIG. 22 judges whether the right end has been determined or not. In the case where the judgment in step S50 is NO, step S51 judges whether the sheet is detected by the right sheet upper end sensor 84*b* or not. In the case where the judgment in step S51 is NO, the right chucker counter is reset to zero in step S56. If the judgment in step S51 is YES, on the other hand, the count on the right chucker counter is incremented by one in step S52. Step S53 judges whether the count on the right chucker counter is larger than a reference value N2 or not. And if the result is YES, step S54 determines the right end position of the sheet, followed by step S55 for judging that the right end has been determined. In this case, the right end position is given as (reference position of carrier 72+sensor distance−count on right chucker counter).

Step S57 judges whether the left and right ends have been determined, and if the judgment is YES, the movement of the carrier 72 is ended in step S58 thereby to end the process. In the case where the judgment in step S57 is NO, on the other hand, step S59 judges whether the carrier 72 has exceeded the target position or not. If the result of judgment in step S59 is NO, the process returns to step S43 for continuing the process. In the case where the result of judgment in step S59 is YES, the process proceeds to step S60 for determining the undetermined one of the left and right ends. In step S61, the movement of the carrier 72 is stopped.

The undetermined one of the left and right ends can be described as follows. In determining the left end, for example, it was explained above that the left sheet upper end sensor 84*a* crosses the left end of the sheet. However, the left sheet upper end sensor 84*a*, if located above the sheet from the beginning, never crosses the left end of the sheet, and cannot detect the left end of the sheet. In such a case, the leftward minimum value of the reference position of the carrier 72 is set as the left end position. The right end position, if not yet determined, is represented by the rightward maximum value of the reference position.

Figure 23:
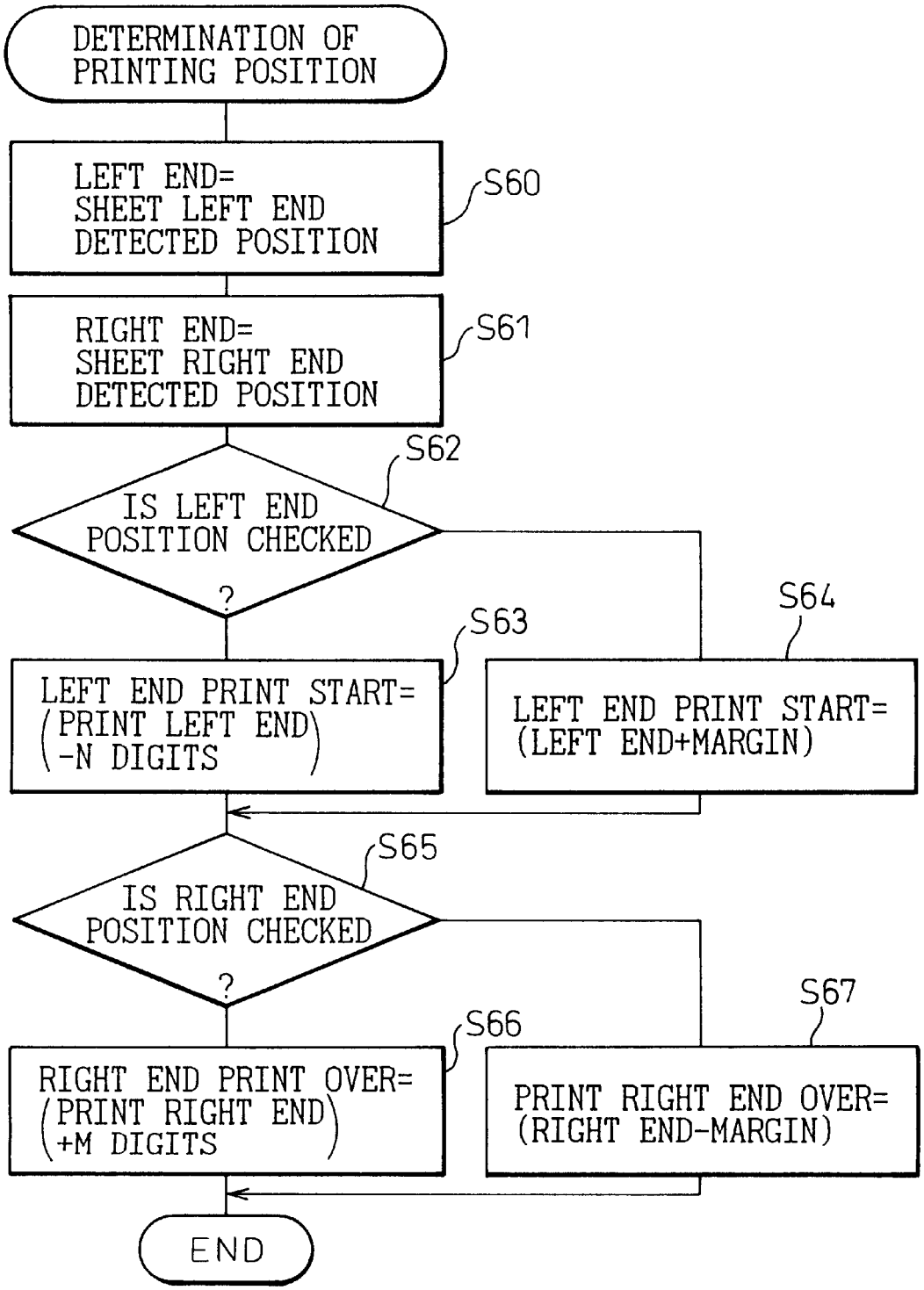
FIG. 23 is a flowchart continued for controlling the determination of the printing position.

FIG. 23 is a flowchart for controlling the determination of the printing position. In steps S60, S61, the left and right ends of the sheet determined above are used. Step S62 judges whether the left end position of the sheet is located inside or outside of a predetermined area. In the case where the left end position of the sheet is located outside of the predetermined area, the process proceeds to step S63, while in the case where the left end position of the sheet is located inside of the predetermined area, the process proceeds to step S64. In similar fashion, step S65 judges whether the right end position of the sheet is located outside or inside of a predetermined area. If the right end position of the sheet is located outside of the predetermined area, the process proceeds to step S66, while if the right end position of the sheet is located inside of the predetermined area, the process proceeds to step S67.

Figure 24A:
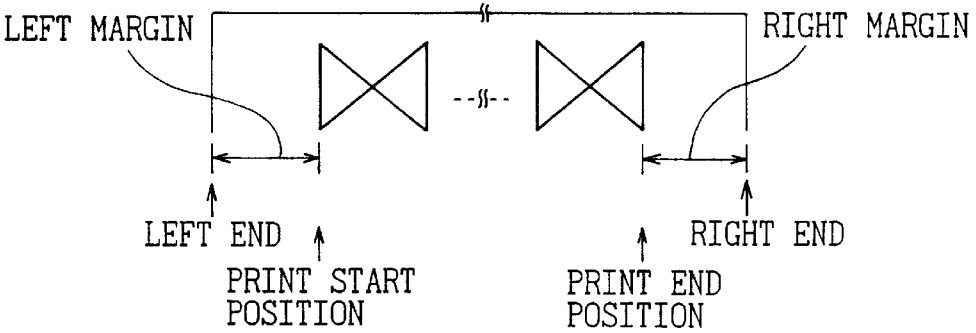
FIGS. 24A and 24B are views for explaining the determination of the printing position.
Figure 24B:
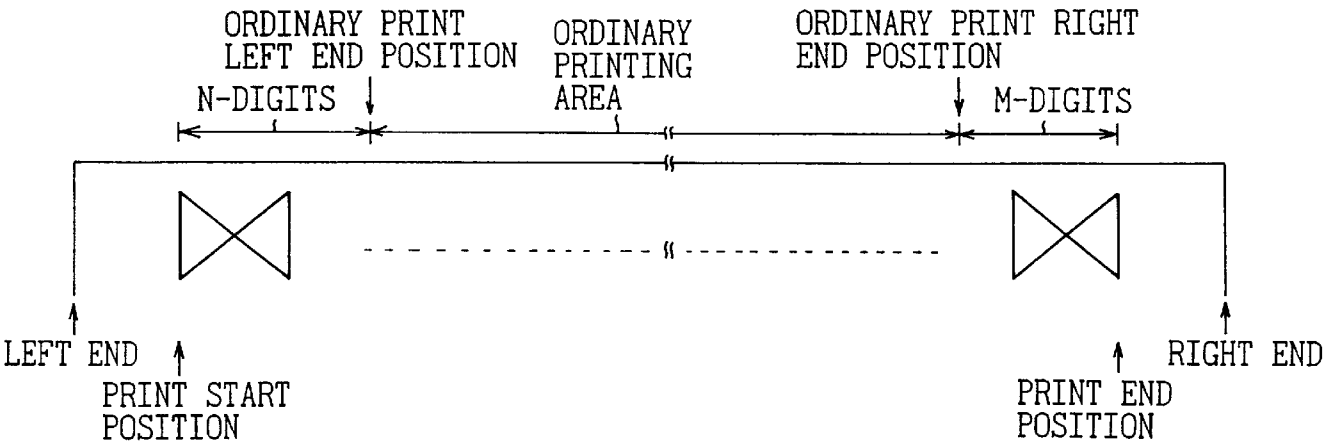

FIGS. 24A and 24B are views for explaining the operation of FIG. 23. FIG. 24A designates the case in which the sheet width is so small that the left and right ends of the sheet are located inside of a predetermined area. FIG. 24B represents the case in which the sheet width is so large that the left and right end positions of the sheet are located outside of the predetermined area. In FIG. 24B, the predetermined area is described as an ordinary printing area. In this case, the ordinary printing area is the one for the printer 50 with the sheet supply apparatus 10 not mounted thereon. The printing head 74 of the carrier 72 can move over a wider area than the ordinary printing area. The ordinary printing area is defined as an area smaller than the range covered by the printing head by N digits for the left side and by M digits for the right side.

In steps S64, S67, as in the case of FIG. 24A, the actually-detected positions of the left and right ends taking into the left and right margins into account are determined as the printing start position and the printing end position, respectively. In steps S63 and S66, as in the case of FIG. 24B, the left and right limit positions where the printing head 74 of the carrier 72 can actually move are determined as the printing start position and the printing end position, respectively. In this way, by detecting the sheet width, the printing head 74 of the carrier 72 can be moved quickly to print a wider range.

Figure 25:
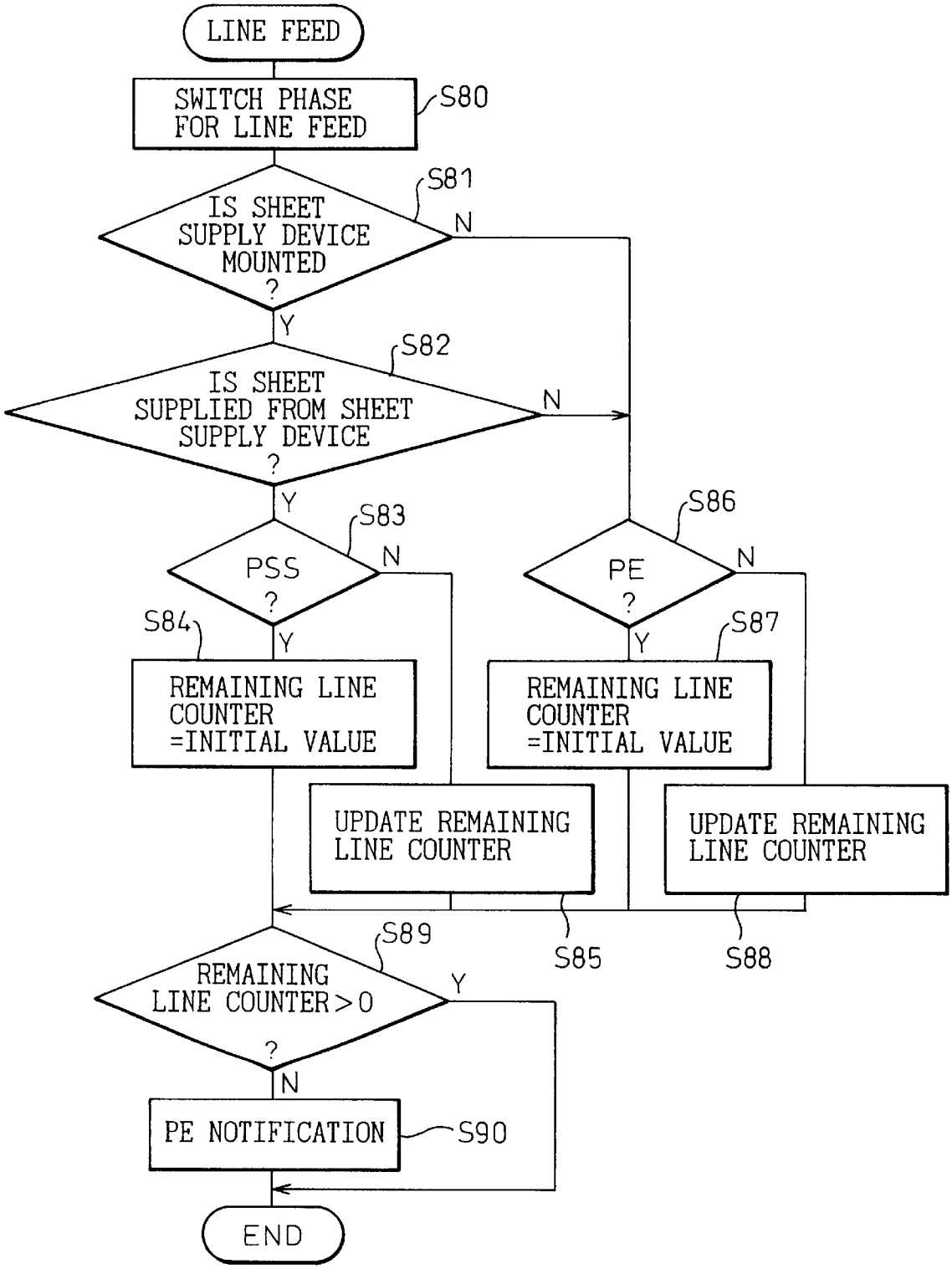
FIG. 25 is a flowchart for phase switching for line feeding including the detection of the lower end of the sheet.

FIG. 25 is a flowchart for controlling the line feed. The supply sensors 42 of the sheet supply apparatus 42 are used also for detecting the lower end position of the sheet. Further, as shown in FIG. 6, the printer 50 includes a sheet sensor 82 arranged in the vicinity of the sheet conveyance rollers 60 and 62. This sheet sensor 82 detects the lower end position of the sheet in the absence of the sheet supply apparatus 10.

In step S80, the phase is switched for line feed, and step S81 judges whether the sheet supply apparatus 10 is mounted on the printer 50 or not. In the case where the judgment in step S81 is YES, step S82 judges whether the sheet is the one supplied from the sheet supply apparatus 10 or not. In the case where the judgment in step S82 is YES, step S83 judges whether the supply sensor 42 is turned on or not. If the judgment in step S83 is YES, the remaining lines counter for line feed is set to initial value in step S84, and in the case where the judgment in step S83 is NO, it is judged that the lower end of the sheet has passed the supply sensors 42, the value on the remaining lines counter for line feed is updated in step S85. In the case where a plurality of the supply sensors 42 are turned on, it is judged that the lower end of the sheet has passed the supply sensors 42 at the time point when all the supply sensors 42 turn off.

In the case where the judgment in steps S81 and S82 is NO, step S86 judges whether the sheet sensor (PE) 82 of the printer 50 is turned on or not. In the case where the result of judgment in step S86 is YES, the remaining lines counter for line feed is set to initial value in step S87, while if the judgment in step S86 is NO, it is judged that the lower end of the sheet has passed the supply sensors 42, so that the count on the remaining lines counter for line feed is updated. Then, step S89 judges whether the count on the remaining lines counter for line feed is larger than zero, and if the result of judgment is NO, the remaining lines counter continues to be updated in step S88, and when the count on the remaining lines counter for line feed reaches zero, a PE notification is issued in step S90. The remaining lines counter for line feed continue to count until the lower end margin reaches a predetermined amount, and when the lower end margin of the sheet reaches the predetermined amount, the printing operation is stopped, and the PE notification (notification of the end of the printing operation) is given to a control unit, for example, and the required process is further performed.

The lower end of the sheet is detected by the supply sensors 42 in such a manner that when a plurality of sensors used for detecting the presence or absence of a sheet in the sheet supply apparatus 10 all judge that there is no sheet, it is judged that the lower end of the sheet is reached, and the printing area of the lower end of the sheet is determined. Also, even in the case where the diagonal travel correction ends successful in the sheet supply apparatus 10, a small diagonal remains. Therefore, it is judged that the lower end of the sheet has been reached, only after all the sensors judge that there is no sheet. In the case where a single sensor detects that a sheet is present, it is judged that the lower end of the sheet has been reached when the particular sensor detects the lower end of the sheet.

As described above, according to this invention, a sheet supply apparatus comprises a plurality of sheet supply sensors arranged in spaced relation to each other in the direction perpendicular to the direction of sheet conveyance, wherein any type of sheet can be randomly set over the whole range of the sheet conveyance surface and the diagonal travel of the sheet can also be corrected. Also, the width and the diagonal travel of a randomly set sheet can be detected without reducing the processing speed. It is thus possible to provide a sheet supply apparatus and a recording apparatus having a smaller number of component parts and being lower in cost.

We claim:

1. A sheet supply apparatus comprising:

a sheet conveyance surface for inserting a sheet thereon;

an inclined feeding correcting device for conveying a sheet on said sheet conveyance surface and correcting inclined feeding of the sheet;

a plurality of sensors for detecting the presence or the absence of a sheet on said sheet conveyance surface beyond the inclined feeding correcting device in the sheet conveyance direction and in the direction perpendicular to the sheet conveyance direction;

said inclined feeding correcting device including a shaft arranged rotatably above said sheet conveyance surface, a plurality of protrusions formed on said shaft in an axially spaced relationship and at circumferentially different phases and a rotating unit for rotating said shaft, whereby a sheet is conveyed by said protrusions along said sheet conveyance surface toward a transverse member extending in the direction perpendicular to the sheet conveyance direction, so as to cause said sheet to abut against said transverse member to thereby correct inclined feeding of the sheet; and said sensors being arranged on a line parallel to said shaft in a spaced relationship.

2. A sheet supply apparatus as described in claim 1, further comprising a sheet conveyance amount determining means for determining the sheet conveyance amount of said shaft in response to the number of the sensors that have detected presence of a sheet.

3. A sheet supply apparatus as described in claim 1, wherein said sheet conveyance surface has depressions corresponding to the positions of said protrusions.

4. A recording apparatus comprising a casing, a movable carrier, a printing head mounted to said carrier, a platen opposed to said printing head, a pair of sheet conveyance rollers arranged on one side of said platen, and a sheet supply apparatus capable of supplying a sheet toward said sheet conveyance rollers;

said sheet supply apparatus including:

a frame having a sheet conveyance surface;

an inclined feeding correcting device for conveying a sheet on said sheet conveyance surface and correcting inclined feeding the sheet;

a plurality of sensors for detecting presence or absence of a sheet placed on said sheet conveyance surface beyond the inclined feeding correcting device;

said inclined feeding correcting device including a shaft arranged rotatably above said sheet conveyance surface, a plurality of protrusions formed on said shaft at an axially spaced relationship and at circumferentially different phases, and a rotating unit for rotating said shaft, whereby a sheet is conveyed by said protrusions toward said sheet conveyance rollers, so as to cause said sheet to abut against said sheet conveyance rollers to thereby correct inclined feeding of the sheet; said sensors being arranged on a line parallel to said shaft in a spaced relationship.

5. A recording apparatus as described in claim 4, further comprising means for determining the drive amount of said shaft in accordance with the type of the sheet in response to the output of said sensor.

6. A recording apparatus as described in claim 4, further comprising means for moving said carrier in response to the output signals of said sensors.

7. A recording apparatus as described in claim 4, further comprising means for detecting the lower end of a sheet in response to the output of said sensors.

8. A recording apparatus as described in claim 4, further comprising a pair of sheet upper end sensors arranged on said carrier, and means for detecting the upper end of a sheet in response to the output of said sheet upper end sensors.

9. A recording apparatus as described in claim 8, further comprising means for detecting inclined feeding of a sheet in response to the output of said sheet upper end sensors.

10. A recording apparatus as described in claim 9, further comprising retry means for driving said sheet conveyance rollers and said shaft in reverse to discharge said sheet to said sheet supply apparatus when inclined feeding of the sheet is detected, and then reactivating said sheet supply apparatus to again supply the sheet toward said sheet conveyance rollers.

11. A recording apparatus as described in claim 8, further comprising means for detecting the width of a sheet in response to the output of said sheet upper end sensors.

12. A recording apparatus as described in claim 11, further comprising retry means for driving said sheet conveyance rollers and said shaft in reverse to discharge the sheet to said sheet supply apparatus when the width of said sheet is detected to be smaller than a predetermined value, and then reactivating said sheet supply apparatus to again supply said sheet toward said sheet conveyance rollers.

* * * * *